US009869315B2

(12) United States Patent
Jang et al.

(10) Patent No.: US 9,869,315 B2
(45) Date of Patent: Jan. 16, 2018

(54) SCROLL COMPRESSOR HAVING CAPACITY VARYING VALVES

(71) Applicant: LG ELECTRONICS INC., Seoul (KR)

(72) Inventors: Kitae Jang, Seoul (KR); Jaesang Lee, Seoul (KR); Inho Won, Seoul (KR); Byeongchul Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 101 days.

(21) Appl. No.: 14/965,084

(22) Filed: Dec. 10, 2015

(65) Prior Publication Data

US 2016/0169228 A1 Jun. 16, 2016

(30) Foreign Application Priority Data

Dec. 16, 2014 (KR) ..... 10-2014-0181709

(51) Int. Cl.
*F04C 18/02* (2006.01)
*F04C 28/24* (2006.01)
(Continued)

(52) U.S. Cl.
CPC ..... *F04C 28/26* (2013.01); *F04C 18/0215* (2013.01); *F04C 29/023* (2013.01); *F04C 2240/811* (2013.01)

(58) Field of Classification Search
CPC ..... F01C 1/0207–1/0292; F01C 2021/1643; F01C 20/26; F04C 2/025;
(Continued)

(56) References Cited

U.S. PATENT DOCUMENTS 4,382,370 A * 5/1983 Suefuji ..... F04C 23/00 62/324.1
4,514,150 A * 4/1985 Hiraga ..... F04C 28/16 417/440
(Continued)

FOREIGN PATENT DOCUMENTS

CN 1793657 6/2006
CN 200955502 10/2007
(Continued)

OTHER PUBLICATIONS

Chinese Office Action dated Jul. 17, 2017.

*Primary Examiner* — Laert Dounis
(74) *Attorney, Agent, or Firm* — Ked & Associates LLP

(57) ABSTRACT

A scroll compressor is provided that may include a casing, an orbiting scroll and a non-orbiting scroll that suctions in a refrigerant from a suction space of the casing, compresses the suctioned refrigerant in a plurality of compression chambers, and discharges the compressed refrigerant into a discharge space of the casing, and a capacity varying device having a first valve and at least one second valve coupled with each other inside of the casing to selectively bypass a portion of the refrigerant in the plurality of compression chambers. With this structure, it is possible to prevent, in advance, refrigerant from being leaked outside of the scroll compressor, reduce pressure loss as a bypass flow path is shortened, reduce a size, weight, and manufacturing costs of the scroll compressor, and vary a capacity of the scroll compressor with a small operating force, and small power consumption.

10 Claims, 20 Drawing Sheets

(51) Int. Cl.
*F04C 28/26* (2006.01)
*F04C 29/02* (2006.01)

(58) Field of Classification Search
CPC ... F04C 18/0207–18/0292; F04C 14/26; F04C 28/26
USPC ..... 418/55.1–55.6, 180
See application file for complete search history.

(56) References Cited

U.S. PATENT DOCUMENTS 4,744,733 A * 5/1988 Terauchi ..... F04C 28/16 417/310
4,904,164 A * 2/1990 Mabe ..... F04C 28/16 417/308
4,940,395 A * 7/1990 Yamamoto ..... F04C 28/16 417/310
5,240,388 A * 8/1993 Matsumoto ..... F04C 28/12 417/299
5,855,475 A * 1/1999 Fujio ..... F04C 18/0215 418/15
2004/0265140 A1* 12/2004 Sun ..... F04C 28/26 417/310
2009/0196781 A1* 8/2009 Kiem ..... F04C 18/0215 418/55.1

FOREIGN PATENT DOCUMENTS

| | | |
|---|---|---|
| CN | 102089523 | 6/2011 |
| CN | 103573619 | 2/2014 |
| EP | 2 679 823 | 1/2014 |
| JP | 5-223073 | 8/1993 |

* cited by examiner

SCROLL COMPRESSOR HAVING CAPACITY VARYING VALVES

CROSS REFERENCE TO RELATED APPLICATION(S)

Pursuant to 35 U.S. §119(a), this application claims the benefit of earlier filing date and right of priority to Korean Application No. 10-2014-0181709, filed in Korea on Dec. 16, 2015, the contents of which is incorporated by reference herein in its entirety.

BACKGROUND

1. Field

A scroll compressor is disclosed herein.

2. Background

In general, a compressor is a device that compresses a fluid, such as a refrigerant gas, and may be classified as a rotary compressor, a reciprocating compressor, or a scroll compressor, for example, according to a method for compressing a fluid. The scroll compressor is a high-efficiency, low-noise compressor, which is widely applied in the field of air conditioners. The scroll compressor is configured such that an orbiting scroll having a wrap (hereinafter, referred to as an "orbiting wrap"), and a non-orbiting scroll having a wrap (hereinafter, referred to as a "non-orbiting wrap") engaged with the orbiting wrap perform a relative orbiting motion. In the scroll compressor a plurality of compression chambers including a suction chamber, an intermediate pressure chamber, and a discharge chamber is formed between the orbiting wrap and the non-orbiting wrap. A volume of the plurality of compression chambers is decreased as the plurality of compression chambers continuously move in a central direction during a process in which the orbiting scroll and the non-orbiting scroll perform a relative orbiting motion, so that a refrigerant is continuously sectioned in, compressed, and discharged.

The scroll compressor can be divided into a closed-type scroll compressor, in which a compression mechanism and an electric motor are installed together in a closed casing, and an open-type scroll compressor in which a compression mechanism operated by an external drive is installed in a casing.

Hereinafter, an open-type scroll compressor will be described.

FIG. 1 is a sectional view of a conventional open-type scroll compressor. As shown in FIG. 1, in the conventional open-type scroll compressor, a main frame 2 is installed in an internal space of a casing 1, and a first end of a drive shaft 3 is inserted into the main frame 2 to be rotatably coupled to the main frame 2.

An orbiting scroll 4 is coupled to a second end of the drive shaft 3, and a non-orbiting scroll 5 is coupled to the orbiting scroll 4. The non-orbiting scroll 5 is coupled to the main frame 2 with the orbiting scroll interposed therebetween. An orbiting wrap 4*a* and a non-orbiting wrap 5*a* are formed at or on the orbiting scroll 4 and the non-orbiting scroll 5, respectively. The orbiting wrap 4*a* and the non-orbiting wrap 5*a* form a plurality of compression chambers P including a suction chamber, an intermediate pressure chamber, and a discharge chamber when the orbiting wrap 4*a* is rotated with respect to the non-orbiting wrap 5*a*.

A suction port 5*b* that communicates with the suction chamber is formed at one side of the non-orbiting scroll 5, a discharge port (not shown) that communicates with the discharge chamber is formed at a center of the non-orbiting scroll 5, and an intermediate pressure hole 5*c* that communicates with the intermediate pressure chamber is formed between the suction port 5*b* and the discharge port (not shown) of the non-orbiting scroll 5. The suction port 5*b* communicates with a suction space 1*a* of the casing 1 to which a suction pipe 11 is connected. The discharge port (not shown) communicates with a discharge space 1*b* of the casing 1 to which a discharge pipe (not shown) is connected. The intermediate pressure hole 5*c* communicates with a capacity varying unit or device 9.

The capacity varying unit 9 includes a first bypass pipe 91 that communicates with the intermediate pressure hole 5*c*, a second bypass pipe 92 that communicates with the suction pipe 11, and an opening/closing valve 93 that provides communication between the first bypass pipe 91 and the second bypass pipe 92 or blocks communication between the first bypass pipe 91 and the second bypass pipe 92. A first end of the first bypass pipe 91 communicates with the intermediate pressure hole 5*c* at an inside of the casing 1 by passing through the casing 1 and a second end of the first bypass pipe 91 communicates with the opening/closing valve 93 outside of the casing 1. A first end of the second bypass pipe 92 communicates, with the suction pipe 11 outside of the casing 1 and a second end of the second bypass pipe 92 communicates with the opening/closing valve 93. The opening/closing valve 93 is provided outside of the casing 1.

While the first end of the drive shaft 3 is supported by the main frame 2, a circumference of the second end of the drive shaft 3 is supported by a sub-frame 6 coupled to the main frame 2. A thrust surface 2*b* that supports the orbiting scroll 4 in a shaft or axial direction and a shaft hole 2*d* through which the drive shaft 3 passes are formed at the main frame 2.

A front cover 7 that forms a portion of the casing 1 is coupled to the sub-frame 6, and an oil pump 8 that pumps oil stored in the casing 1 to a sliding portion and a compression mechanism is installed in the front cover 7. The oil pump 8 is coupled to the second end of the drive shaft 3, and the drive shaft 3 is coupled to a drive pulley 3*b* provided outside of the casing 1 by passing through the front cover 7. The drive pulley 3*b*, for example, is connected to an external drive source (not shown) driven by gas to drive the compression mechanism when necessary.

In the conventional scroll compressor described above, the drive pulley 3*b* is connected to the external drive source (not shown), so that an external drive force is transmitted to the compression mechanism through the drive shaft 3. Then, the orbiting scroll 4 coupled to the drive shaft 3 performs an orbiting motion by an eccentric distance in a state in which the orbiting scroll 4 is supported by the main frame 2, and simultaneously, the plurality of compression chambers P including the suction chamber, the intermediate pressure chamber, and the discharge chamber are successively formed between the rotating wrap 4*a* and the non-orbiting wrap 5*a*. A volume of the plurality of compression chambers P is decreased as the plurality of compression chambers P are continuously moved in a central direction by a continuous orbiting motion of the orbiting scroll 4, so that a refrigerant that flows into the suction space 1*a* of the casing 1 is continuously sectioned, compressed, and discharged into the discharge space 1*b* of the casing 1.

Also, in the conventional scroll compressor, a compression capacity is varied by the capacity varying unit 9. That is, as opening/closing value 93 allows the first bypass pipe 91 and the second bypass pipe 92 to communicate with each other, a refrigerant in the intermediate pressure chamber is bypassed into the suction space 1*a* via a bypass flow path including the intermediate pressure hole 5*c*, the first bypass pipe 91, the opening/closing valve 93, the second bypass pipe 92, and the suction pipe 11. Accordingly, a partial load operation in which the compression capacity is decreased can be performed. On the other hand if the opening/closing valve 93 blocks the communication between the first bypass pipe 91 and the second bypass pipe 92, the bypassing of the refrigerant is stopped. Thus, the refrigerant in the intermediate pressure chamber is compressed without being leaked through the intermediate pressure hole 5*c*, and accordingly, a full load operation in which the compression capacity is not decreased can be performed.

However, in the conventional scroll compressor described above, the capacity varying unit 9 for varying the capacity of the compressor is exposed outside of the casing 1. That is a portion of the first bypass pipe 91, the opening/closing valve 93, and the second bypass pipe 92 are exposed outside of the casing 1. Therefore, as the bypass flow path is lengthened, a pressure loss is increased. In addition, refrigerant is leaked outside of the compressor from each connection portion, that is, a connection portion between the first bypass pipe 91 and the casing 1, a connection portion between the first bypass pipe 91 and the opening/closing valve 93, a connection portion between the opening/closing valve 93 and the second bypass pipe 92, or a connection portion between the second bypass pipe 92 and the suction pipe 11, and a size, weight, and manufacturing cost of the compressor are increased.

Also, as the opening/closing valve 93 directly opens and closes the bypass flow path, the conventional scroll compressor should be operated while enduring a pressure of the bypassed refrigerant, which requires a considerable operating force. Therefore, a considerable power is required to vary the capacity of the compressor.

BRIEF DESCRIPTION OF THE DRAWINGS

Embodiments will, be described in detail with reference to the following drawings which like reference numerals refer to like elements, and wherein.

DETAILED DESCRIPTION

Description will now be given of embodiments with reference to the accompanying drawings. For the sake of brief description with reference to the drawings, the same or equivalent components will be provided with the same reference numbers and repetitive description thereof has been omitted.

Hereinafter, a scroll compressor according to an embodiment will be described with reference to the accompanying drawings.

Figure 1:
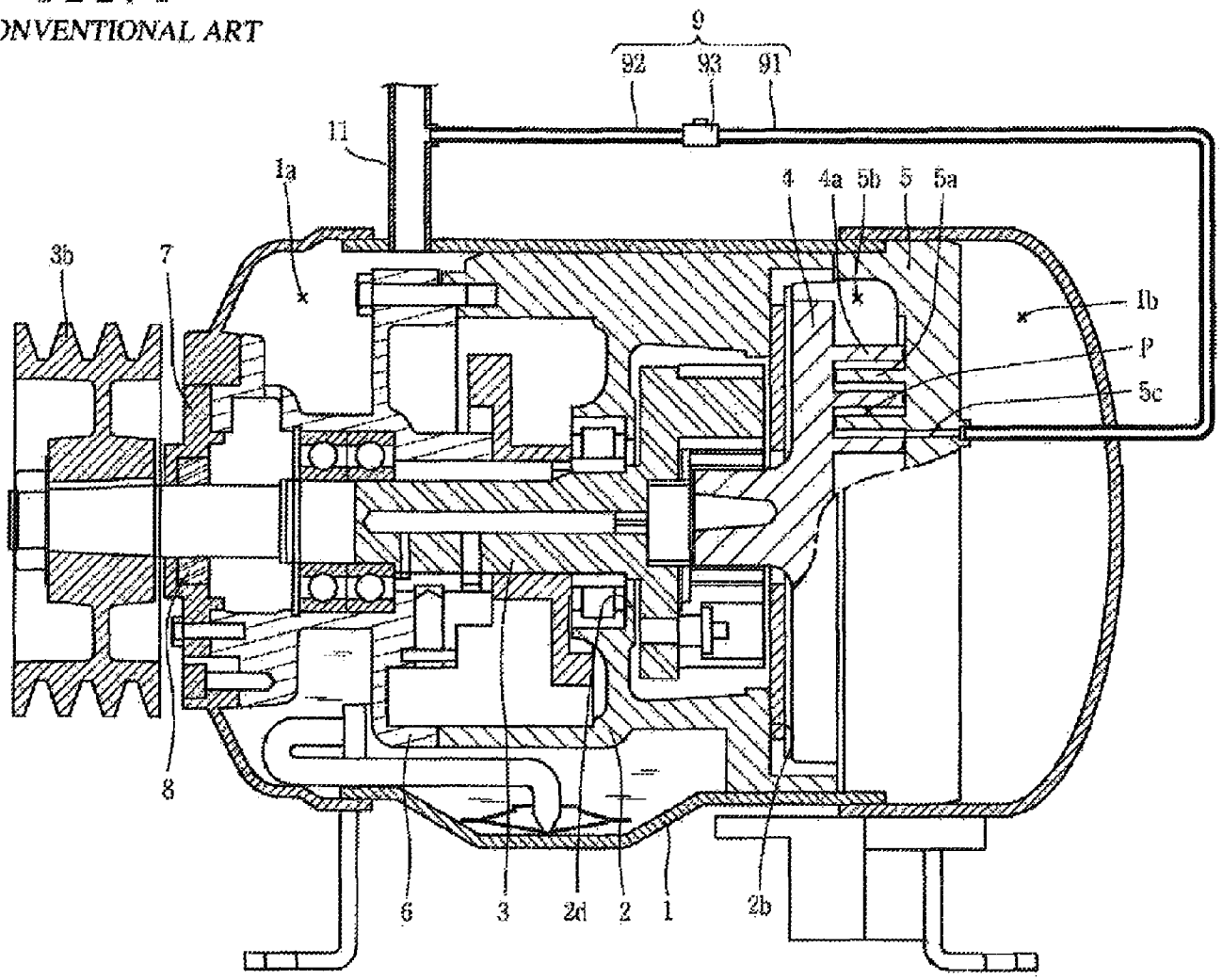
FIG. 1 CONVENTIONAL ART
FIG. 1 is a cross-sectional view of a conventional open-type scroll compressor.
Figure 2:
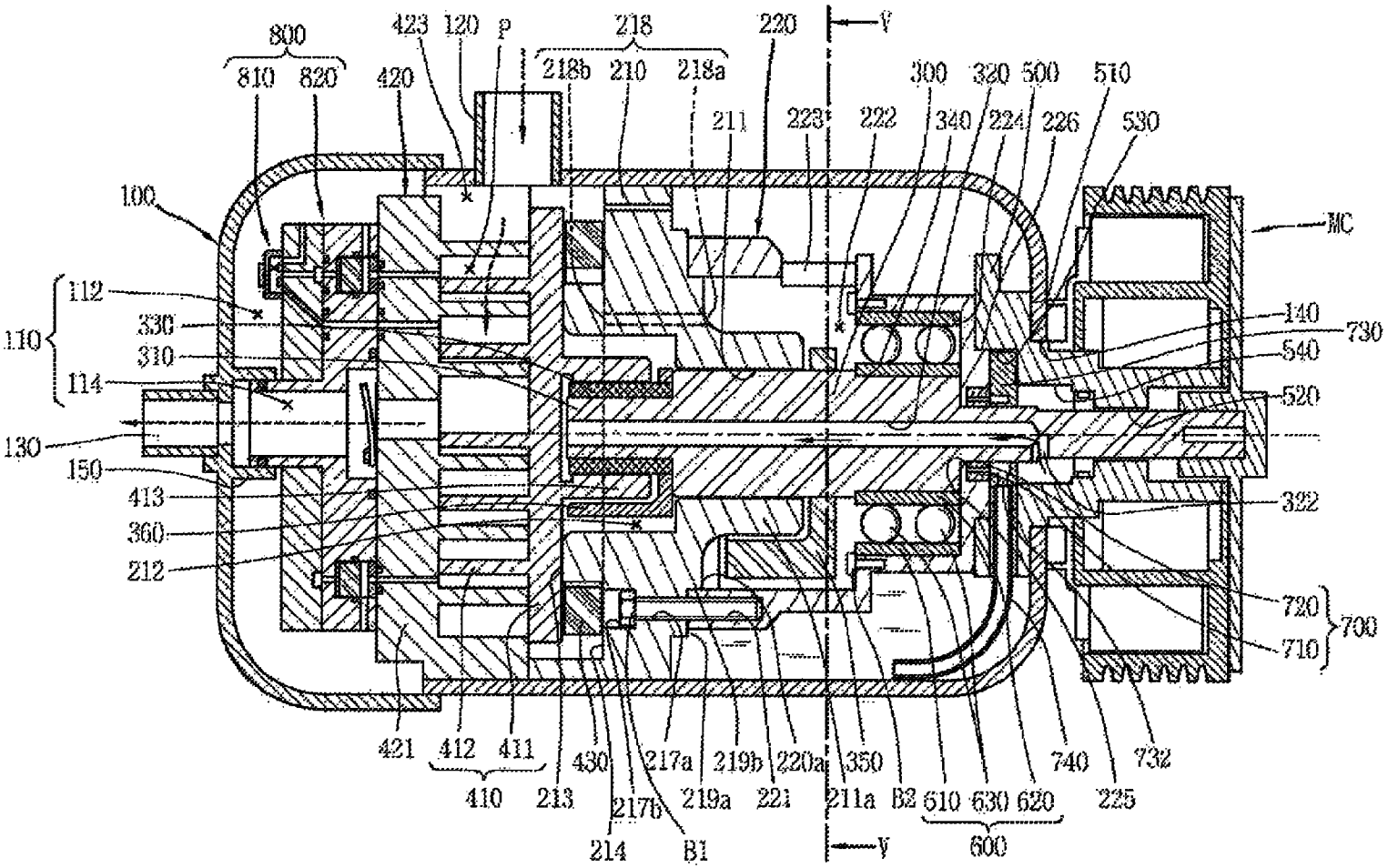
FIG. 2 is a cross-sectional view of scroll compressor according to an embodiment.
Figure 3:
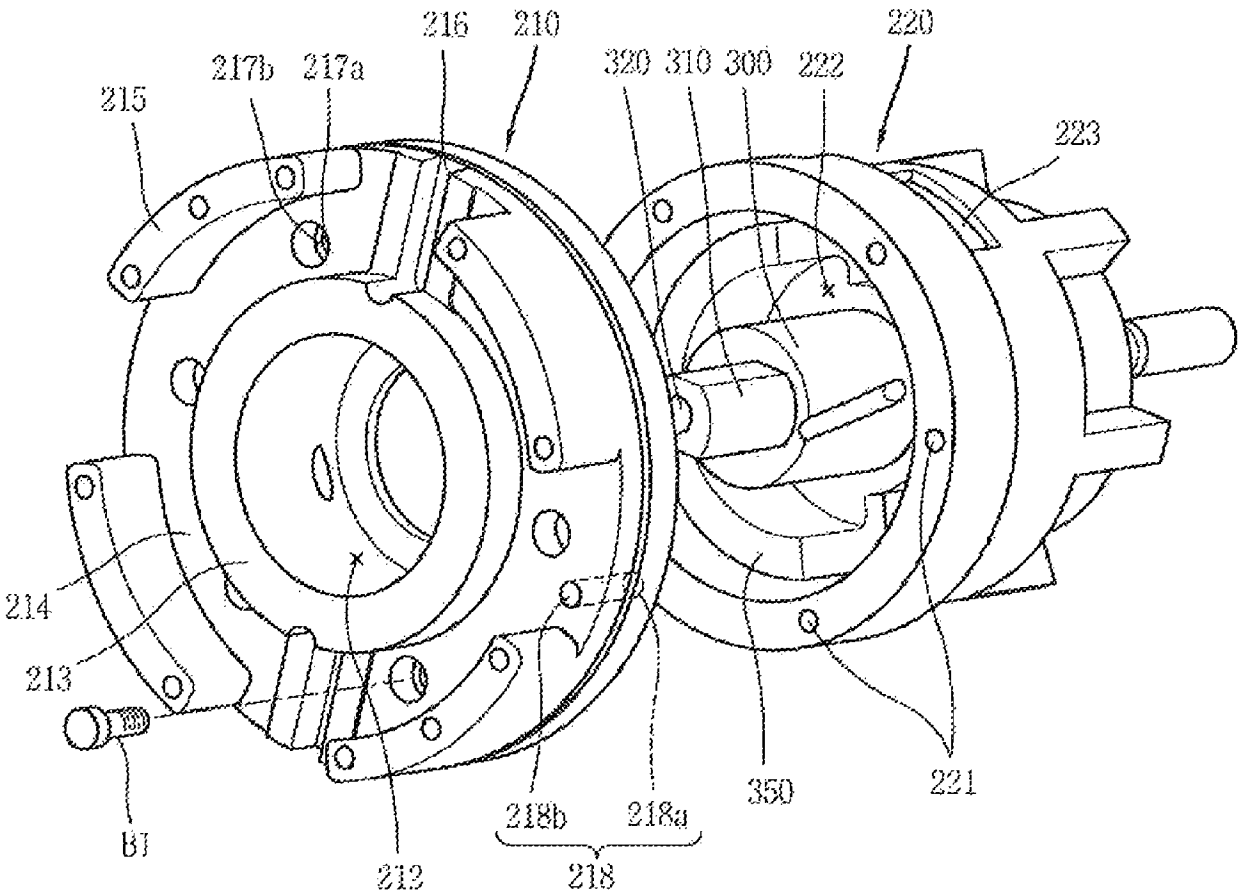
FIG. 3 is a exploded perspective view of a main frame and a sub-frame in the scroll compressor of FIG. 2.
Figure 4:
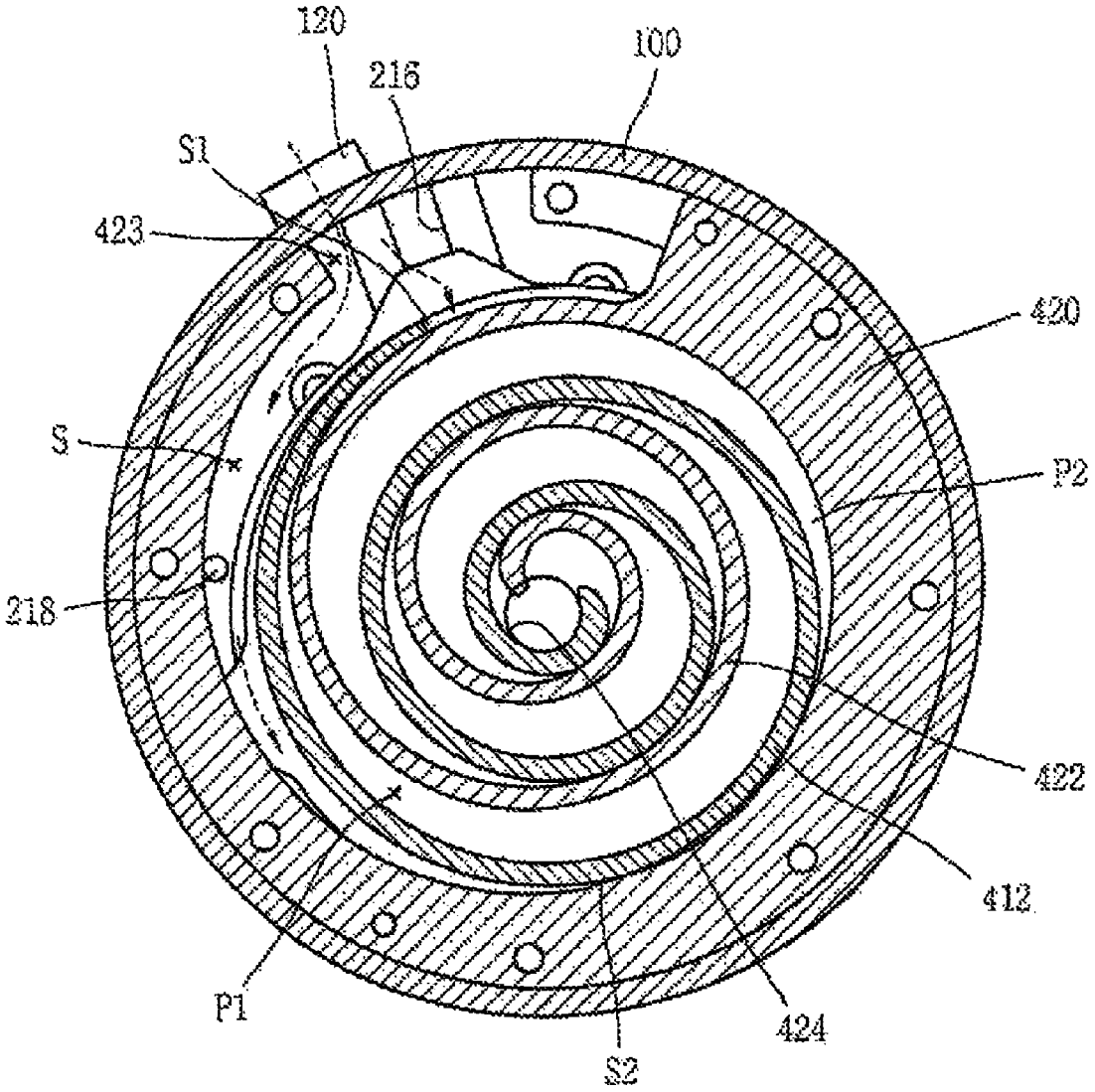
FIG. 4 is a cross-sectional view of a compression mechanism in the scroll compressor of FIG. 2.
Figure 5:
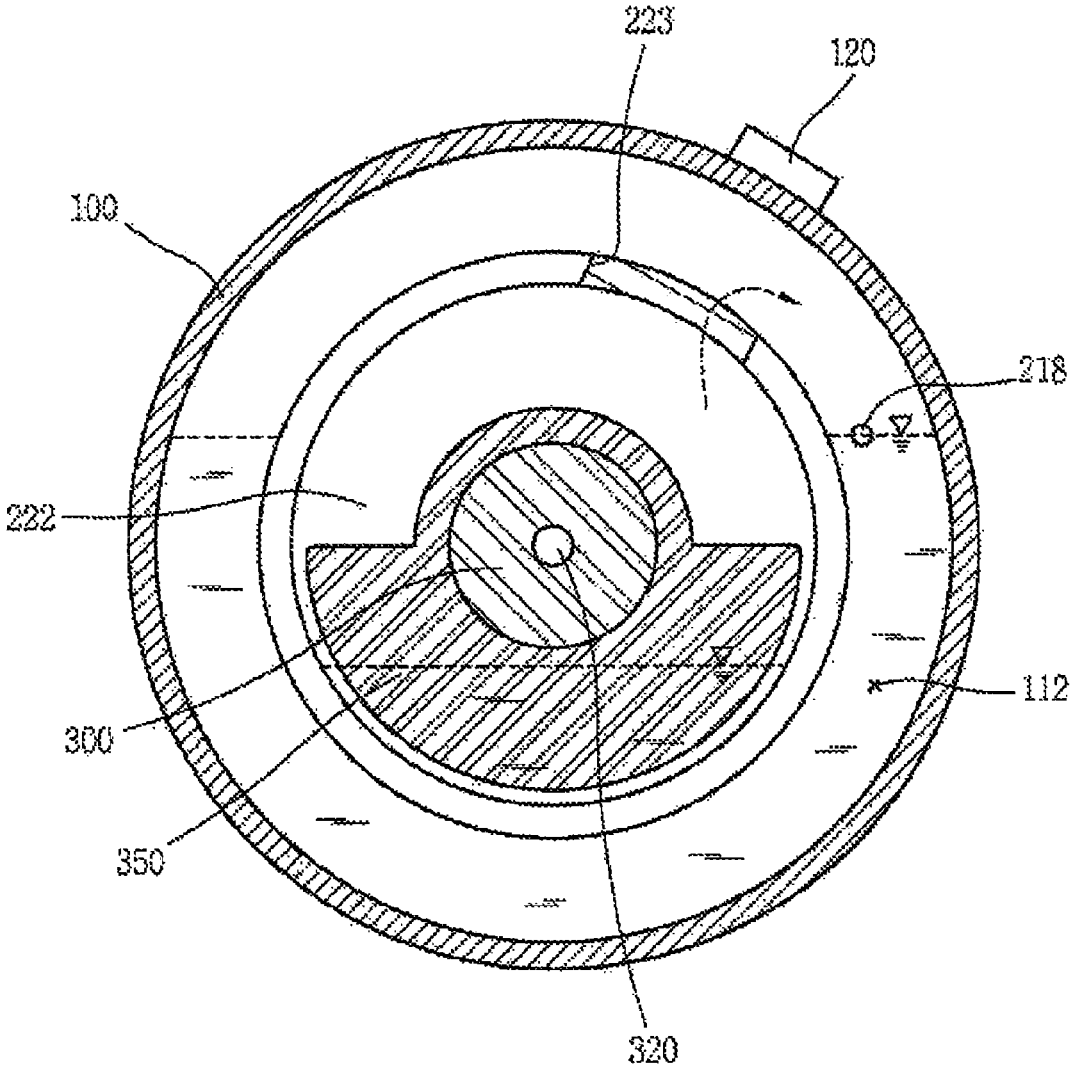
FIG. 5 is a cross-sectional view taken along line V-V, showing an embodiment of a position of an oil discharge hole in the scroll compressor of FIG. 2.
Figure 6:
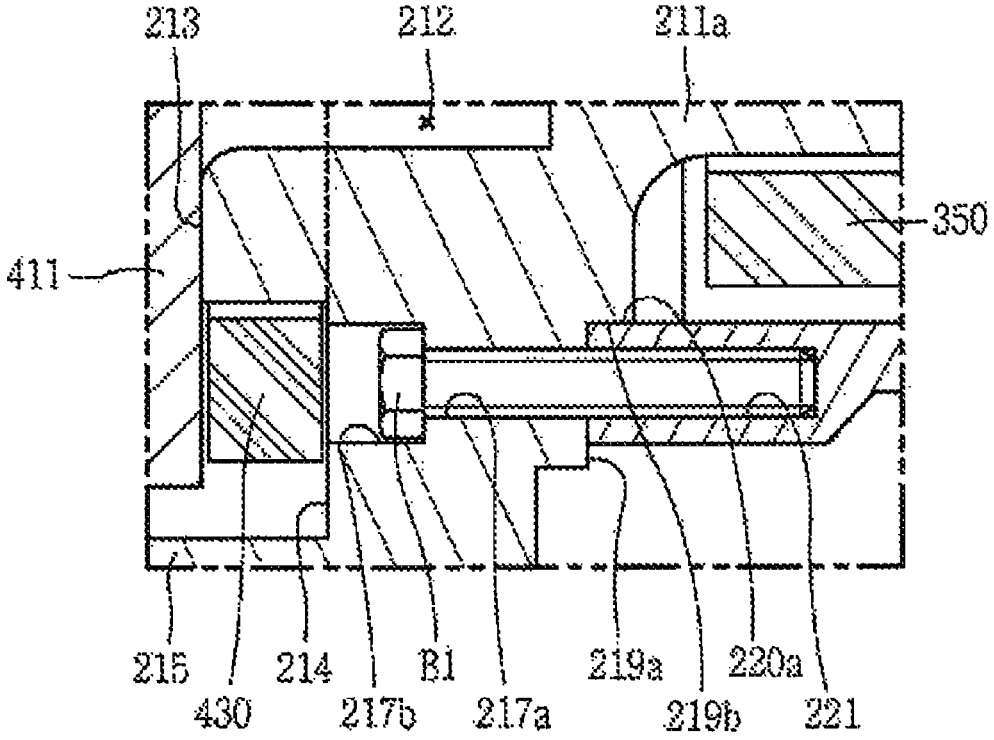
FIG. 6 is an enlarged cross-sectional view showing a coupling state of the main frame and the sub-frame in the scroll compressor of FIG. 2.
Figure 7:
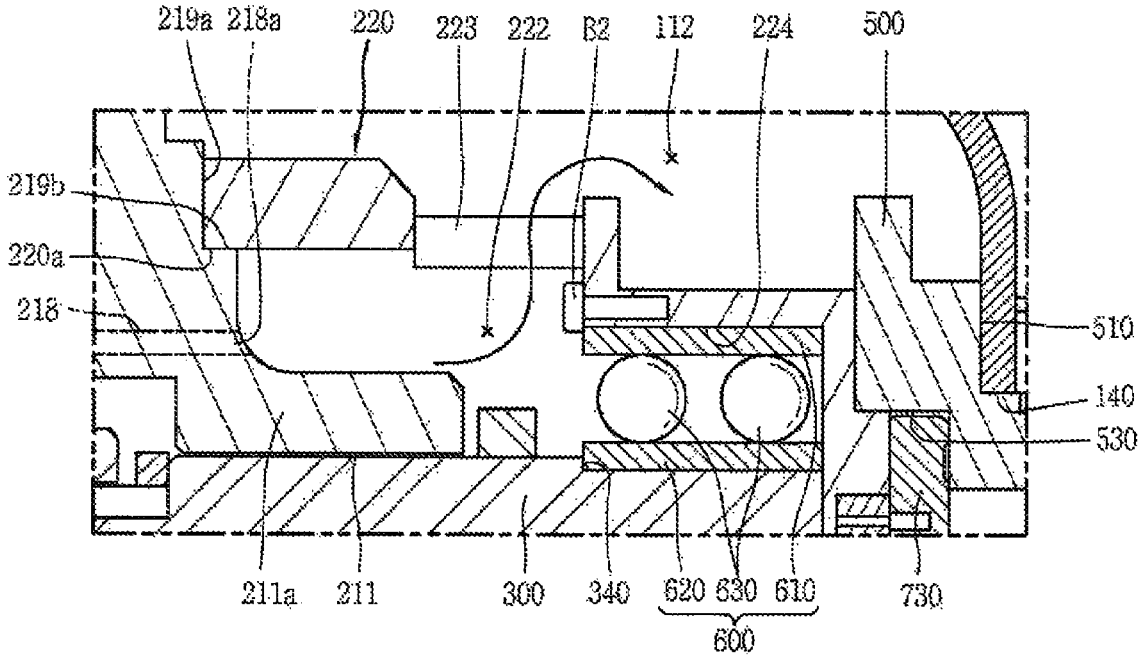
FIG. 7 is a cross-sectional view showing a coupling structure of the sub-frame in the scroll compressor of FIG. 2.
Figure 8:
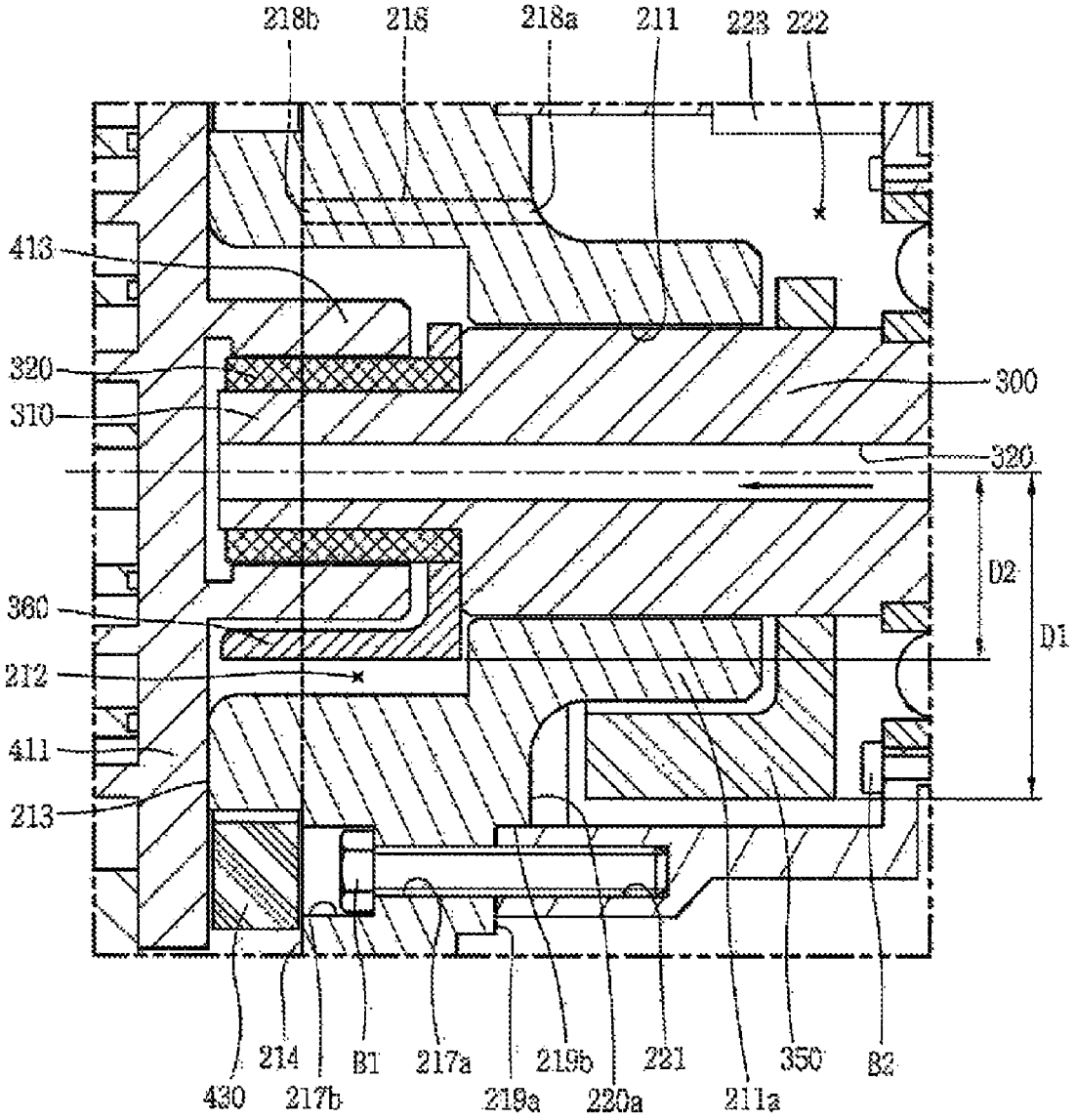
FIG. 8 is a cross-sectional view showing a relationship between a balance weight and a thrust surface in the scroll compressor of FIG. 2.
Figure 9:
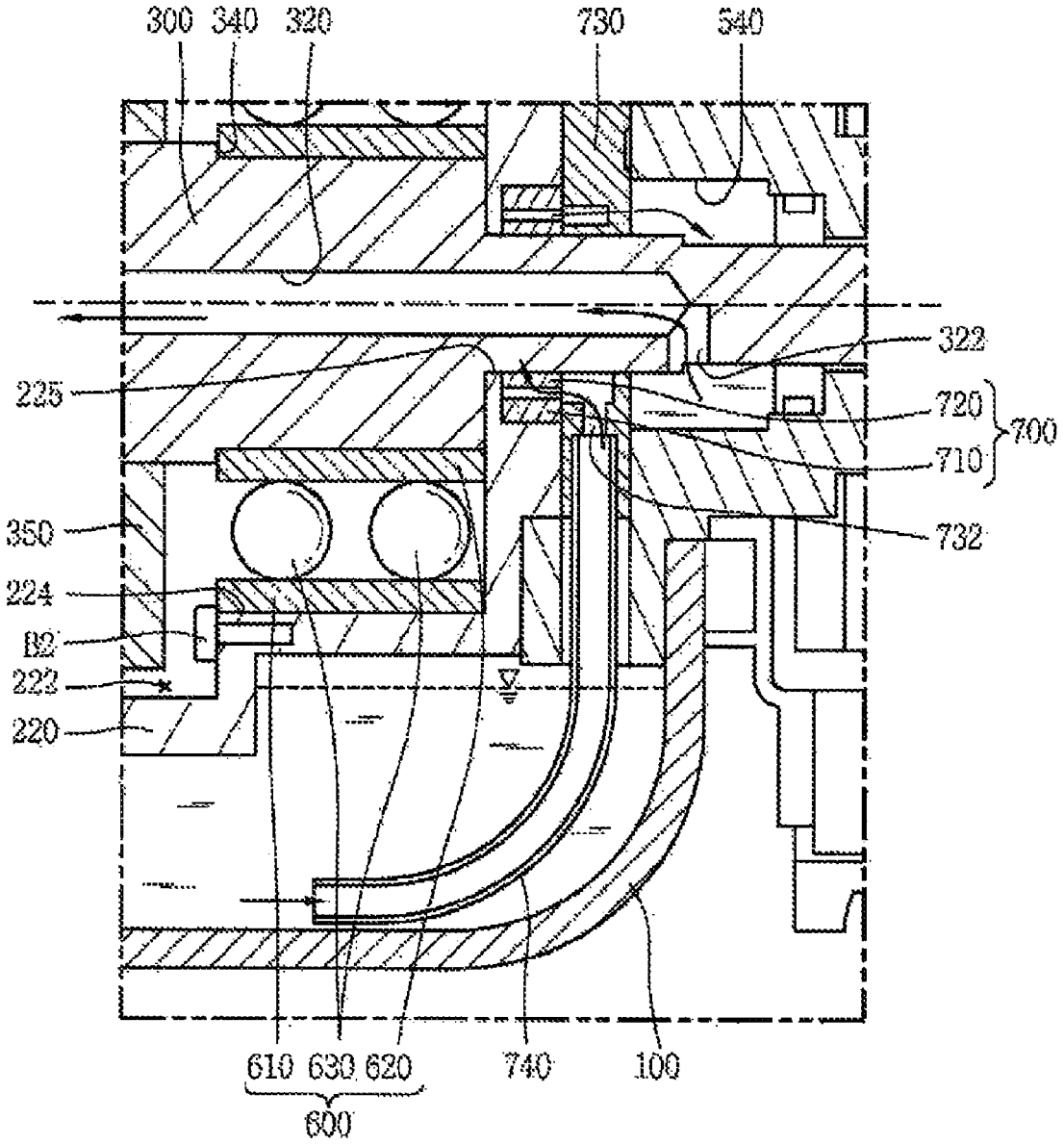
FIG. 9 is a cross-sectional view of an oil supply structure in the scroll compressor of FIG. 2.
Figure 10:
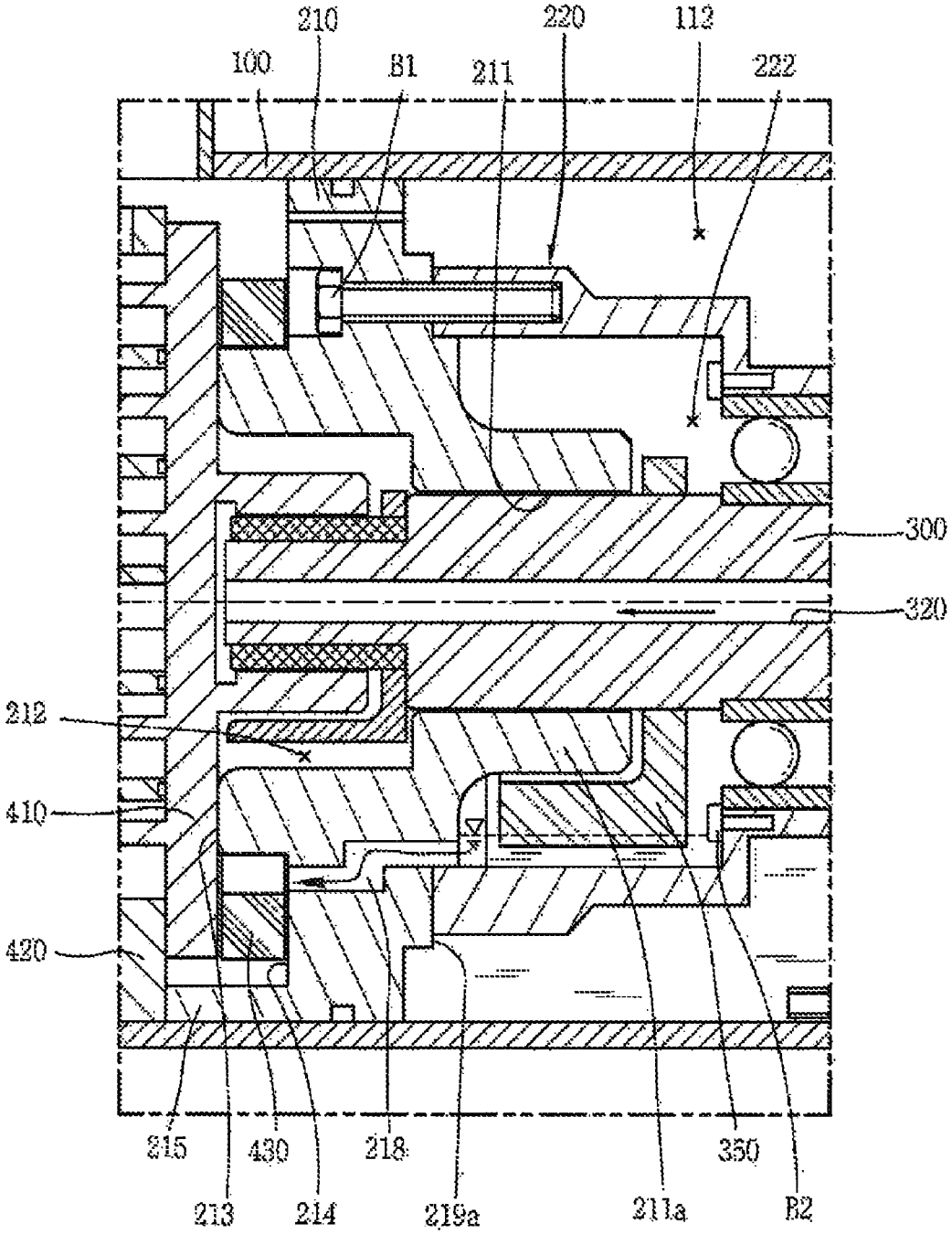
FIG. 10 is a cross-sectional view showing another embodiment of the position of the oil discharge hole in the scroll compressor of FIG. 2.
Figure 11:
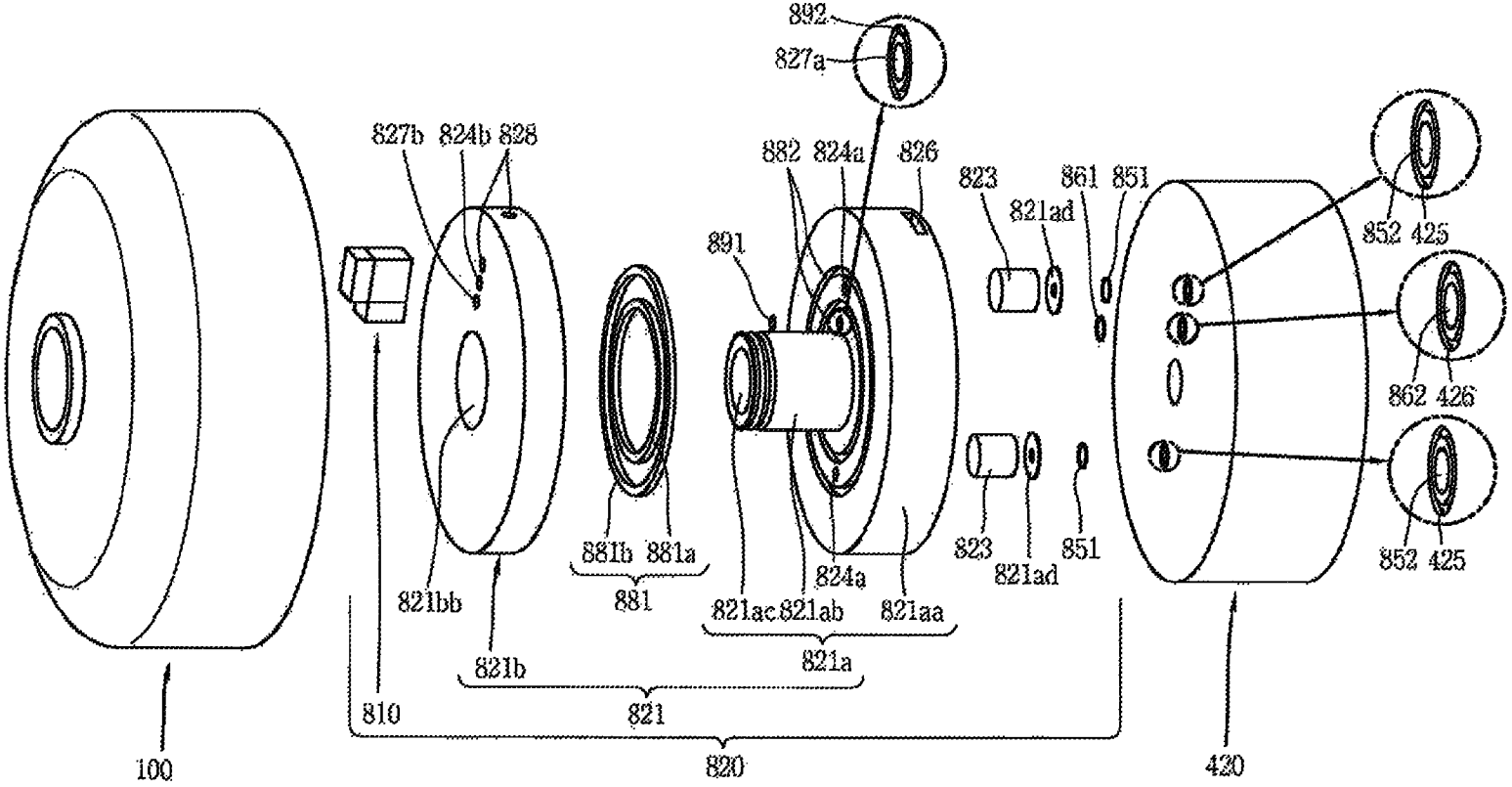
FIG. 11 is an exploded perspective view of a capacity varying device in the scroll compressor of FIG. 2.
Figure 12:
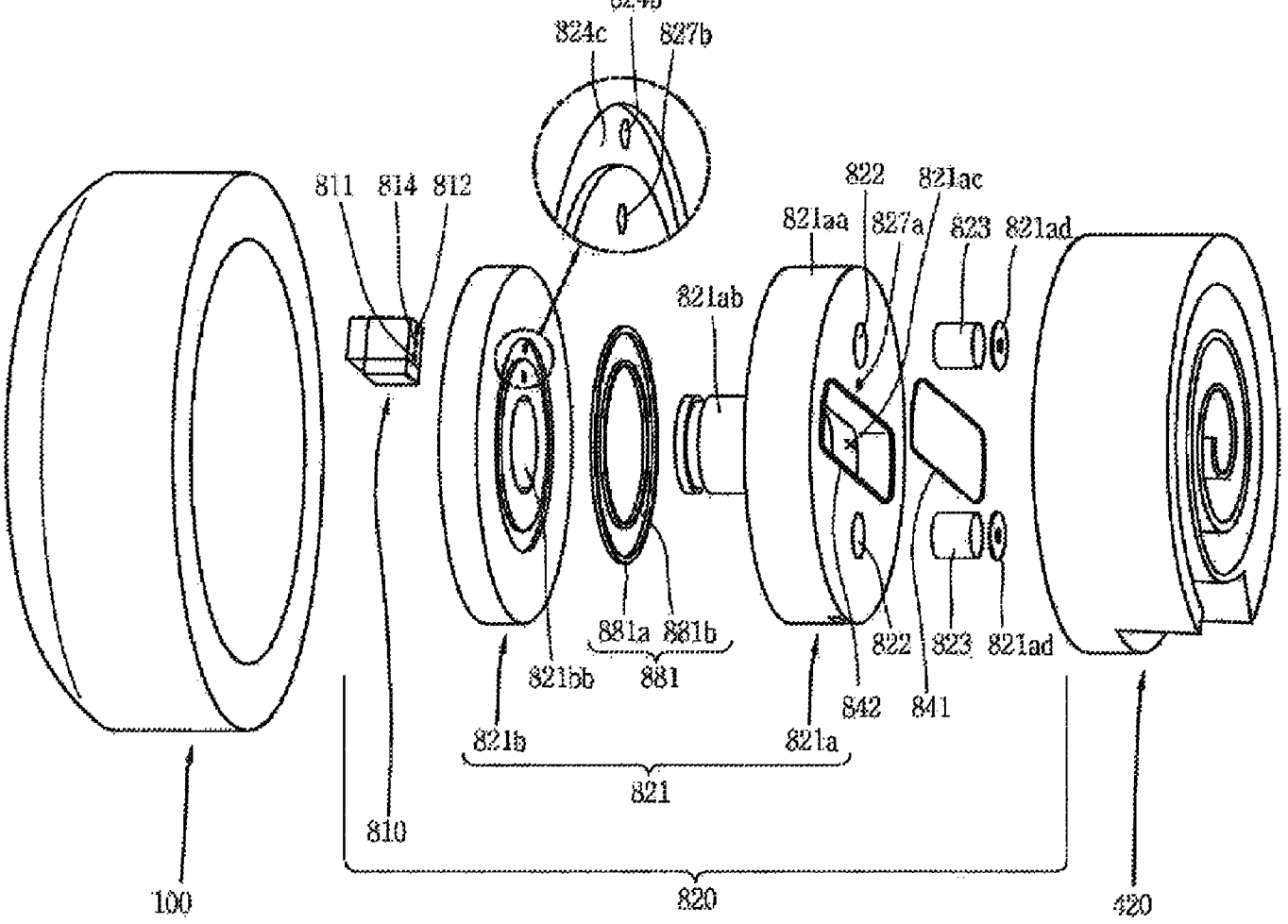
FIG. 12 is an exploded perspective view of the capacity varying device of FIG. 11 viewed from the other side of FIG. 11.
Figure 13:
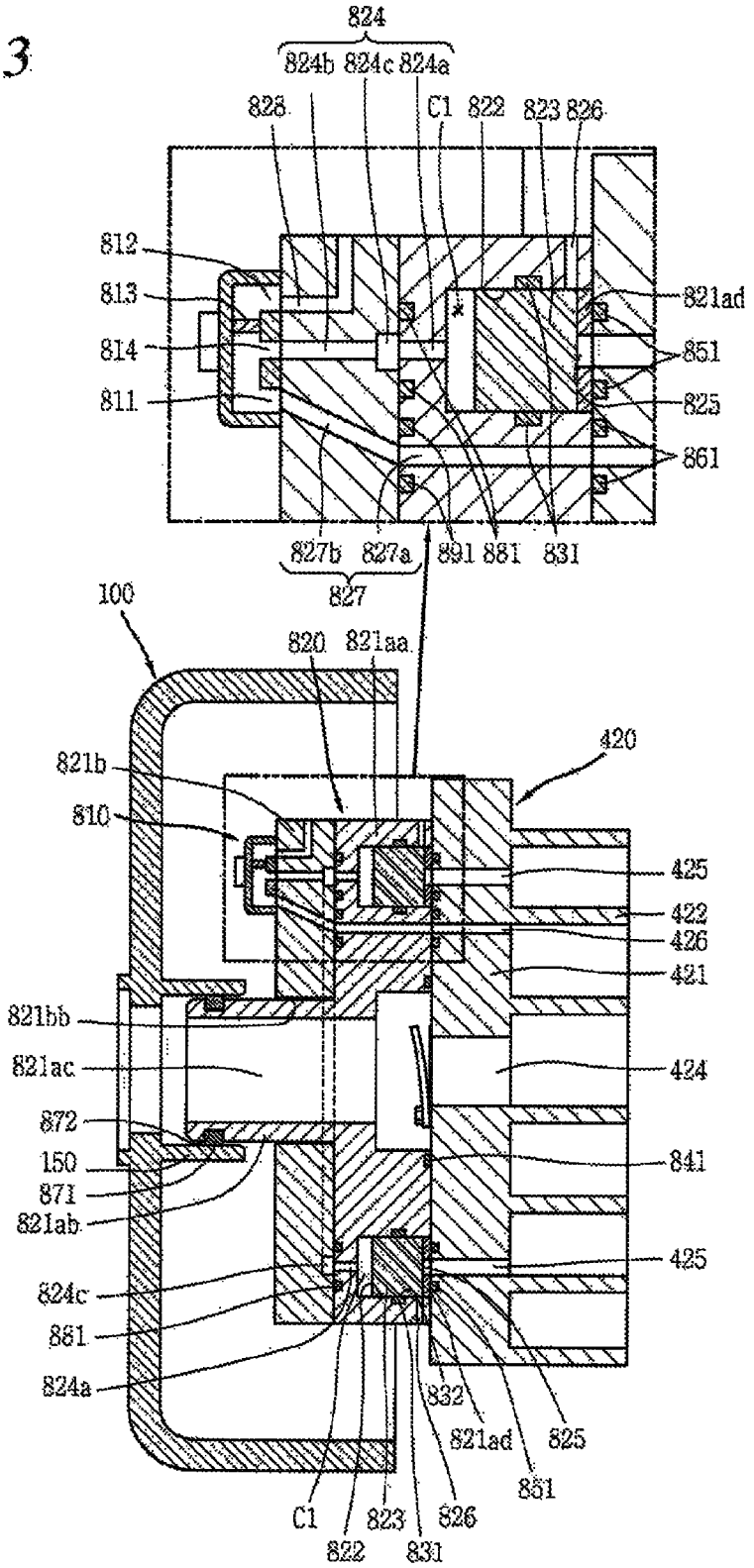
FIG. 13 is a cross-sectional view of the capacity varying device of FIG. 11 in a full load operating state.
Figure 14:
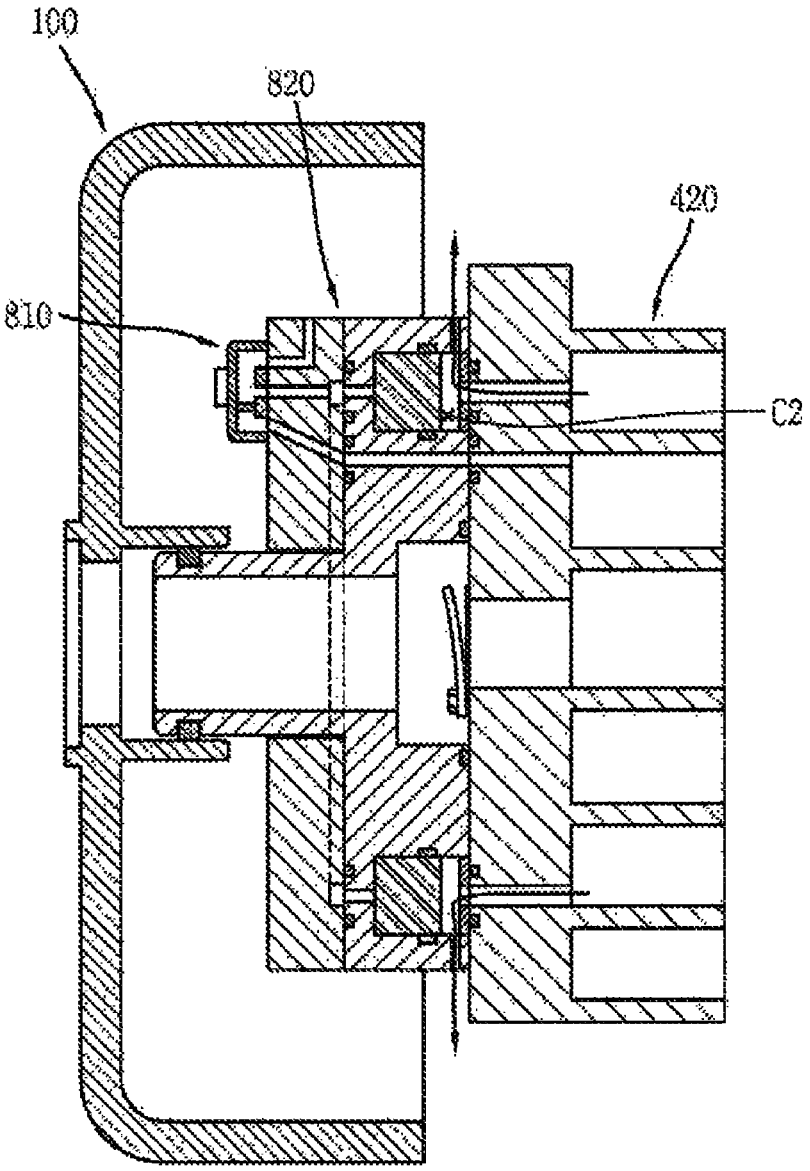
FIG. 14 is a cross-sectional view showing when a partial load operation is performed on the capacity varying device of FIG. 13.

FIG. 2 is a cross-sectional view showing a scroll compressor according to an embodiment. FIG. 3 is an exploded perspective view of a main frame and a sub-frame in the scroll compressor of FIG. 2. FIG. 4 is a cross-sectional view of a compression mechanism in the scroll compressor of FIG. 2. FIG. 5 is a cross-sectional view taken along line V-V, showing an embodiment of a position of an oil discharge hole in the scroll compressor of FIG. 2. FIG. 6 is an enlarged cross-sectional view showing a coupling state of the main frame and the sub-frame in, the scroll compressor of FIG. 2. FIG. 7 is a cross-sectional view showing a coupling structure of the sub frame in the scroll compressor of FIG. 2. FIG. 8 is cross-sectional view showing a relationship between a balance weight and a thrust surface in the scroll compressor of FIG. 2. FIG. 9 is a cross-sectional view of an oil supply structure in the scroll compressor of FIG. 2. FIG. 10 is a cross-sectional view of another embodiment of the position of the oil discharge hole in the scroll compressor of FIG. 2. FIG. 11 is an exploded perspective view of a capacity varying device in the scroll compressor of FIG. 2. FIG. 12 is an exploded perspective view of the capacity varying device of FIG. 11, viewed from the other side of FIG. 11. FIG. 13 is a cross-sectional view of the capacity varying device of FIG. 11 in a full load operating state in the scroll compressor of FIG. 2. FIG. 14 is a cross-sectional view showing when a partial load operation is performed on the capacity varying device of FIG. 13.

As shown in these figures, the scroll compressor according to an embodiment may include a main frame 210 fixedly installed in an internal space 110 of a casing 100, a non-orbiting scroll 420 fixedly coupled to the main frame 210, an orbiting scroll 410 that forms a plurality of compression chambers P that successively move while the orbiting scroll 410 performs a relative motion with respect to the non-orbiting scroll 420 engaged therewith, a drive shaft 300 having a first side or end coupled to a drive source (not shown) provided outside of the casing 100 and a second side or end coupled to the orbiting scroll 410, to transmit power of the drive source (not shown) to the orbiting scroll 410, a sub-frame 220 coupled to the main frame 210, the sub-frame 220 supporting, together with the main frame 210, the drive shaft 300, and a capacity varying unit or device 800 that selectively bypasses a portion of a refrigerant compressed in the plurality of compression chambers P.

The internal space 110 of the casing 100 may be divided into a suction space 112 as a low pressure portion and a discharge space 114 as a high pressure portion by a ring-shaped wall 150 that protrudes in a ring shape from an inner wall surface of the casing 100 and a first block 821*a* coupled to the ring-shaped wall 150. A suction pipe 120 may be connected to the suction space 112, and a discharge pipe 130 may be connected to the discharge space 114. Accordingly, a refrigerant may be sectioned into the suction space 112 through the suction pipe 120 to flow into the plurality of compression chambers P. Then, the refrigerant may be compressed in the plurality of compression chambers P, discharged into the discharge space 114, and then move into a freezing cycle through the discharge pipe 130, thereby forming a low-pressure type compressor. An outer circumferential surface of the main frame 210 may be adhered closely to an inner circumferential surface of the casing 100 and may be for example, thermally joined or welded to the inner circumferential surface of the casing 100.

A shaft hole 211 having a bush bearing (no numeral) functioning as a main bearing by supporting a main bearing portion (no numeral) of the drive shaft 300 in a radial direction may be formed to pass through a center of the main frame 210. An orbiting space 212 may be formed at a front end of the shaft hole 211 such that a boss 413 of the orbiting scroll 410 may orbit.

A thrust surface 213 may be formed in a ring shape on a leading end surface front of the main frame 210, which may be connected to the orbiting space 212, and an Oldham ring accommodating portion 214, into which an Oldham ring 430 may be inserted, may be formed at a periphery of the thrust surface 213. Also, a plurality of axial direction projections 215 that protrudes an axial direction to be fastened to the non-orbiting scroll 420 may be formed at a predetermined distance along a circumferential direction at a periphery of the Oldham ring accommodating portion 214. A plurality of key grooves 216 may be formed in the Oldham ring accommodating portion 214, such that keys (not shown) of the Oldham ring 430 may be slidingly coupled thereto. One or more bolt hole 217*a* to fasten the main frame 210 and the sub-frame 220 using a fastening bolt B1 and having a head groove 217*b*, into which a bolt head may be inserted, may be formed around or adjacent to the plurality of key groove 216.

At least one oil discharge hole 218 may be formed in the main frame 210 to discharge a portion of oil flowing, into the suction space 112 of the casing 100 in a direction of the plurality of compression chambers P. An inlet 218*a* of the oil discharge hole 218 may be located at a height capable of preventing the oil flowing into the suction space 112 of the casing 100 from flowing into a balancing space 222 of the sub-frame 220 beyond scattering hole 223 of the sub-frame 220, that is, a height lower than or equal to a height of the scattering hole 223 to though the oil discharge hole appears to be formed inside of the balancing space in FIG. 2, the oil discharge hole is formed outside of the balancing space shown in FIG. 5). In addition, an outlet (side opposite to the thrust surface) 218*b* of the oil discharge hole 218 may be formed at a position equal to or lower than a position of the inlet (side of the thrust surface) 218*a*. As shown in FIG. 4, the outlet 218*b* of the oil discharge hole 218 may communicate with a chamber (P2 in this figure) in which a suction end is formed at a relatively low position among a plurality of chambers P1 and P2.

The drive shaft 300 may extend in a lateral direction. A pin 310 coupled to the orbiting scroll 410 in the internal space 110 of the casing 100 may be formed at a first end (hereinafter, referred to as a "front end") of the drive shaft 300, and a magnetic clutch MC may be coupled to a second end (hereinafter, referred to as a "rear end") of the drive shaft 300 at periphery of the casing 100.

An oil flow path 320 may be formed to pass through the drive shaft 300 in the axial direction. The oil flow path 320 may pass through both ends of the drive shaft 300 in the axial direction. However, as an oil pump 700 may be coupled to the drive shaft 300 near the rear end of the drive shaft 300, an inlet end 322 of the oil flow path 329 may be formed to pass through the drive shaft 300 from a center of the drive shaft 300 to an outer circumferential surface of the drive shaft 300.

The pin 310 may be formed to correspond to an axial center of the drive shaft 300, and an eccentric bush or sliding bush 330 may be coupled to the pin 310. In addition, a sub-balance weight 360 that performs an orbiting motion in the orbiting space 212 may be press-fitted onto the eccentric bush or the sliding bush 330 to be coupled to the eccentric bush or sliding bush 330.

The orbiting scroll 410 may be coupled to the first end of the drive shaft 300, and the non-orbiting scroll 420, which does not perform an orbiting motion may be coupled to the orbiting scroll 410. The non-orbiting scroll 420 may be coupled to the main frame 210 with the orbiting scroll 410 interposed therebetween. An orbiting wrap 412 and a non-orbiting wrap 422 may be formed at an end plate 411 of the orbiting scroll 410 and an end plate 421 of the non-orbiting scroll 420, respectively. The orbiting wrap 412 and the non-orbiting wrap 422 may be engaged with each other, thereby forming a plurality of compression chambers P including a suction chamber, an intermediate pressure chamber, and a discharge chamber. The intermediate pressure chamber may be more finely divided according to pressure. For example, the intermediate pressure chamber may be divided into a first intermediate pressure chamber to which a first intermediate pressure defined as a value between a suction pressure and a discharge pressure is applied, and a second intermediate chamber to which a second intermediate pressure defined as a value between the first intermediate pressure and the discharge pressure is applied.

A suction port 423 that communicates with the suction chamber may be formed at a periphery of the non-orbiting wrap 422 of the non-orbiting scroll 420, and a discharge port 424 that communicates with the discharge chamber may be formed at a center of the end plate 421 of the non-orbiting scroll 420. In addition, at least one first intermediate pressure hole 425 that communicates with the first intermediate pressure chamber may be formed between the suction port 423 and the discharge port 424 of the non-orbiting scroll 420 and a second intermediate pressure hole 426 that communicates with the second intermediate pressure chamber may be formed between the at least one first intermediate pressure hole 425 and the discharge port 424 of the non-orbiting scroll 420. The suction port 423, the discharge port 424, the at least one first intermediate pressure hole 425, and the second intermediate pressure hole 426 may communicate with the suction space 112 of the casing 100, the discharge space 114 of the casing 100, a second flow path 825 of the capacity varying device 800, and a fourth flow path 827 of the capacity varying, device 800, respectively.

As the orbiting wrap 412 may be formed asymmetrically longer than the non-orbiting wrap 422, the suction port 423 may communicate with a circular arc-shaped suction groove S. The suction groove S may communicate with an inside chamber P1 an outer end (hereinafter, also referred to as "a first suction end") S1 of the orbiting wrap 412. On the other hand, the suction groove S may communicate with an outside chamber P2 at a position at which it is wound inward to about 180 degrees from the outer end S1 of the orbiting wrap 412. Accordingly, a suction stroke may be simultaneously started at the inside pocket P1 and the outside pocket P2. Therefore, first and second suction ends S1 and S2 may be formed such that the suction groove S communicates with each of the chambers P1 and P2.

The sub-frame 220 may be coupled to a rear surface of the main frame 210, and the sub-frame 220 may be coupled to a front cover 500 by passing through the casing 100. Insertion projections may be, respectively, formed between the main frame 210 and the sub-frame 220 and between the sub-frame 220 and the front cover 500, such that a centering operation may be easily performed during assembly of the sub-frame 220. For example, a shaft portion 211*a*, through which the shaft hole 211 may pass, may be formed to extend lengthwise at a rear side of the main frame 210, and a coupling surface 219*a*, to which one end of the sub-frame 220 may be coupled, may be formed around the shaft portion 211*a*. In addition, at least one first insertion projection 219*b* may be stepped with respect to the coupling surface 219*a* to contact an inner circumferential surface 220*a* of the sub-frame 220 at an inside of the coupling surface 219*a*. The at least one first insertion projection 219*b* may be formed in a ring shape, and may include a plurality of the first insertion projection 219*b*.

Unlike the main frame 210, which may be manufactured of cast iron, the sub-frame 220 may be formed of a relatively light material, such as aluminum. The sub frame 220 may be formed in a cylindrical shape having both, ends open, and plurality of bolt grooves 221 may be formed in a front end surface at a front side (direction of the plurality of compression chambers) of the sub-frame 220, such that the fastening bolt B1 may be fastened into the bolt groove 221 to communicate with the bolt hole 217*a* of the main frame 210.

The balancing space 222, in which a thin balance weight 350 may be accommodated, may be formed at a front side of the sub-frame 220. The main balance weight 350 may be inserted onto the drive shaft 300 to be fixedly coupled to d 300 and a radius D1 of the main balance weight 350 may be formed greater than a radius D2 of the sub-balance weight 360. Accordingly, although the cub-balance weight 360 is provided in the orbiting space 212 of the main frame 210, at least a portion of the thrust surface 213 of the main frame 210 may be located within a range of the radius D1 of the main balance weight 350, so that it is possible to improve a support force at a central portion of the orbiting scroll 410.

The scattering hole 223 may be formed in a sidewall surface that forms the balancing space 222 of the sub-frame 220 to pump out oil supplied to a sliding portion through the oil flow path 320 of the drive shaft 300 and then into the balancing space 222. The scattering hole 223 may be formed at a height to prevent oil filled outside of the sub-frame 220, that is, the suction space 112 of the casing 100 from overflowing into the inside of the sub-frame 220 through the oil discharge hole 218, for example a middle or midline height of the casing 100 or higher.

A bearing space 224 may be formed at one side of the balancing space 222 such that a sub-bearing 600 that supports a sub-bearing portion (no numeral) of the drive shaft 300 in the radial direction may be inserted and fixed thereto. A bolt B2 may be fastened around a front side of the bearing space 224 to support, in the axial direction, an outer ring 610 of the sub-bearing 600 inserted in the bearing space 224. An inner ring 620 of the sub-bearing 600 may be press-fitted by a bearing support surface 340 of the drive shaft 300 to be coupled to the bearing support surface 340 while being supported by the bearing support surface 340.

A shaft hole 225 may be formed at a rear side surface of the sub-frame 220, such that the drive shaft 300 may pass therethrough, and a second insertion projection 226 may be formed on a front end surface around the shaft hole 225 to be inserted into the front cover 500 and fixed in the radial direction.

Ends of outer and inner rings 610 and 620 of the sub-bearing 600 may be supported at an inside of a rear side surface of the sub-frame 220. The sub-bearing 600 may be in the form of a multi-row angular contact ball bearing in which balls 630 may be provided in a plurality of rows between the outer and inner rings 610 and 610.

The oil pump 700 that pumps oil stored in the casing 100 to the sliding portion and a compression mechanism may be installed at an outside of the rear side surface of the sub-frame 220. An outer ring 710 of the oil pump 700 may be fixed to the sub-frame 220, and an inner ring 720 of the oil pump 700 may be coupled to the drive shaft 300. Accordingly, when the drive shaft 300 is rotated, oil stored in the casing 100 may be pumped as the inner ring 720 of the oil pump 700 performs a relative motion with respect to the outer ring 710 of the oil pump 700.

The front cover 500 coupled by passing through the casing 100 may be coupled to a front end surface at the rear side of the sub-frame 220. The front cover 500 may be formed in a cylindrical shape having a predetermined length in the axial direction and an outer circumferential surface thereof stepped several times. A sealing surface 510 adhered closely to a circumference of a through-hole 140 of the casing 100 to seal the internal space 110 of the casing 100 may be formed on the outer circumferential surface of the front cover 500. A shaft hole 520 through which the drive shaft 300 may pass, may be formed at a center of the front cover 500. A cover space 530 may be formed at a center of a front end surface at the front side of the front cover 500 to accommodate a pump cover 730 that supports the oil pump 700 therein. An oil flow space 540 may be formed at a rear side of the cover space 530 such that the oil pumped by the oil pump 700 may be guided to the oil flow path 320 of the drive shaft 300. The inlet end 322 of the oil flow path 320 may be formed in the radial direction in the drive shaft 300 such that the oil flow space 540 and the oil flow path 320 may communicate with each other.

An oil supply hole 732 may be formed in the pump cover 730, and an supply pipe 740 may be inserted into and coupled to the oil supply hole 732 to guide oil collected on a bottom surface of the suction space 12 of the casing 100 to a suction pocket of the oil pump 700.

The capacity varying device 800 may be provided at a front side of the non-orbiting scroll 420 to selectively bypass a portion of the refrigerant in the plurality of compression chambers P to the suction space 112 in the internal space 110 of the casing 100. The capacity varying device 800 may include a first valve 810 operated according to an external input signal, and a second valve 820 operated by the first valve 810. The first valve 810 may be coupled to the second valve 820, and the second valve 820 may be fixedly coupled to the non-orbiting scroll 420.

The first valve 810 may be a three-way solenoid valve. That is, the first valve 81 may include a first input port 811 that communicates with the second intermediate pressure chamber, a second input port 812 that communicates with the suction space 112, a solenoid needle 813 movable according to an external signal, and an output port 814 that communicates the first input port 811 or the second input port 812 according to movement of the solenoid needle 813. The first input port 811 may communicate with the second intermediate pressure chamber through the fourth flow path 827 of the second valve 820, and the second input port 812 may communicate with the suction space 112 through a fifth flow path 828 of the second valve 820. In addition, the output port 814 that communicates with the first input port 811 or the second input port 812 may communicate with a first space C1 of a cylinder 822 through a first flow path 824 of the second valve 820. The first valve 810 may be provided in the suction space 112 in consideration of an expos able temperature and pressure.

The second valve 820 may include the cylinder 822 having an internal space inside of a block 821, a piston 823 that divides an internal space of the cylinder 822 into the first space C1 and a second space C2 the piston 823 provided to be movable toward the first space C1 or the second space C2 by a difference between an acting force generated by a refrigerant flowing into the first space C1 and an acting force generated by a refrigerant flowed into the second space C2 the first flow path 824 allowing the first space C1 to communicate with the output port 814, the second flow path 825 allowing the second space C2 to communicate with the first intermediate pressure chamber, a third flow path 826 allowing the second, space C2 to communicate with the suction space 112 when the piston 823 is moved toward the first space C1 the fourth flow path 827 allowing the first input port 811 communicate with the second intermediate pressure chamber, and the fifth flow path 828 allowing the second input port 812 to communicate with the suction space 112.

The first intermediate pressure hole 425, the second flow path 825, the second space C2 of the cylinder 822, and the third flow path 825 may form a bypass flow path that bypasses a refrigerant in the first intermediate pressure chamber to the suction space 112 by moving the piston 823 toward the first space C1. In addition, the second intermediate pressure hole 426, the fourth flow path 827, the first input port 811, the output port 814, the first flow path 824, and the first space C1 (a flow path that guides a refrigerant in the second intermediate pressure chamber to the first space C1 when the first input port 811 communicates with the output port 814) or the fifth flow path 828, the second input port 812, the output port 814, the first flow path 824, and the first space C1 (a flow path that guides a refrigerant in the suction space 112 to the first space C1 when the second input port 812 communicates with the output port 814) may form an opening/closing flow path that opens/closes the bypass flow path.

Two bypass flow paths, for example, may be provided to quickly vary a capacity of the scroll compressor, and one opening/closing flow path may be provided to reduce manufacturing costs. That is, two of each of the first intermediate pressure chamber 425, the second flow path 825, the cylinder 822, the piston 823, and the third flow path 826 may be provided to bypass a large amount of refrigerant at a same time. Further, two of each of the second intermediate pressure hole 426, the fourth flow path 827, the first valve 810, and the, fifth flow path 828 may be provided to correspond to the number of the bypass flow paths, but one of each may be provided as shown in this embodiment. In this case, the bypass flow path may be formed, in terms of reduction in manufacturing costs, such that the output port 814 of the first valve 810, which has one first flow path 824, communicates with two first spaces C1 of the cylinder 822. The first flow path 824 may include two first hole 824*a*, that respectively, communicates with two first spaces C1 of the cylinder 822, a second hole 824*b* that communicates with the output port 814, and a third hole 824*c* that allows the two first holes 824*a* and the one second hole 824*b* to communicate with each other. In this embodiment, two bypass flow paths are formed, but the number of bypass flow piths may be appropriately adjusted to one or three or more.

The block 821 of the second valve 820 may be formed as one block body. However the block 821 may also be formed with two block bodies to facilitate machining. That is, the block 821 may include first block 821*a*, in which the cylinder 822, a first portion of the first flow path 824, the second flow path 825, the third flow path 826, and a first portion of the fourth flow path 827 may be formed, the first block 821*a* accommodating the piston 823 therein, and a second block 821*b*, in which a second portion of the first flow path 824, a second portion of the fourth flow path 827, and the fifth flow path 828 may be formed. In this embodiment the first hole 824*a* of the first flow path 824 may be formed in the first block 821*a*, and the second and third holes 824*b* and 824*c* of the first flow path 824 may be formed in the second block 821*b*. In addition, a portion that communicates with the second intermediate pressure hole 426 in the fourth flow path 827 may be a first hole 827*a* of the fourth flow path 827 and a portion that communicates with the first input port 811 may be a second hole 827*b* of the fourth flow path 827. In this embodiment, the first hole 827*a* of the fourth flow path 827 may be formed in the first block 821*a*, and the second hole 827*b* of the fourth flow path 827 may be formed in the second block 821*b*.

The first block 821*a* may include a cylindrical plate 821*aa*, a projection 821*ab* that protrudes in a cylindrical shape having a smaller radius than the plate 821*aa* at a central side of the plate 821*aa*, and a through-portion 821*ac* that passes through center of the plate 821*aa* and a center of the projection 821*ab*. The cylinder 822, the first hole 824*a* of the first flow path 824, the second flow path 825, the third flow path 826, and the first hole 827*a* of the fourth flow path 827 may be formed in the plate 821*aa*, and the piston 823 may be accommodated in the cylinder 822.

The cylinder 822 may be formed with a cylindrical recessed groove in a rear surface of the plate 821*aa* and a disk-shaped cylinder cover 821*ad* that recovers an opening of the groove. That is, the cylindrical piston 823 may be inserted into the groove of the cylinder 822 at the rear surface of the plate 821*aa*, and the cylinder cover 821*ad* may cover the opening of the groove of the cylinder 822. The cylinder cover 821*ad* may be fixed to the first block 821*a* using a method, such as pressure-fitting or welding. A radius of the cylinder 822 may be the same as a radius of the piston 823, and an axial direction length of the cylinder 822 may be longer than an axial length of the piston 823. Accordingly, the internal space of the cylinder 822 may be divided into two spaces by the piston 823. In this case, based on the piston 823, the internal space at a front side of the cylinder 822 may be the first space C1, and the internal space at a rear side of the cylinder 822 (the internal space at the side of the cylinder cover 821*ad*) may be the second space C2. In addition, an O-ring 831 that prevents leakage between the first space C1 and the second space C2 may be interposed between an inner circumferential surface of the cylinder 822 and an outer circumferential surface of the piston 823. The O-ring 831 may be inserted into an O-ring fixing groove 832 formed in the inner circumferential surface of the cylinder 822 and the outer circumferential surface of the piston 823 to be fixed to the cylinder 822 or the piston 823.

The first hole 824*a* of the first flow path 824 may be formed at a front side of the cylinder 822. That is, the first hole 824*a* of the first flow path 824 may be formed by passing through an inside of the plate 821*aa* in the axial direction from a front surface of the cylinder 822 to a front surface of the plate 821*aa*. The first hole 824*a* of the first flow path 824 may be formed at a portion opposite to a center of a side of the piston 823 so as to minimize a force by which the piston 823 is inclined.

The second flow path 825 may be formed at a rear side of the cylinder 822. That is, the second flow path 825 may be formed by passing through an inside of the cylinder cover 821*ad* in the axial direction from a front surface to a rear surface of the cylinder cover 821*ad*. The second flow path 825 may be formed at a center of a side of the cylinder cover 821*ad*, opposite to the center of the side of the piston 823, so as to minimize the force by which the piston 823 is inclined.

The third flow path 826 may be formed at or in a sidewall of the cylinder 822. That is, the third flow path 828 may be formed by passing through the plate 821*aa* in the radial direction from the inner circumferential surface of the cylinder 822 to an outer circumferential surface of the plate 821*aa*. In addition, the third flow path 826 may communicate with the second space C2 when the piston 828 is moved toward the first space C1. However, in terms of reactivity, the third flow path 826 may be as close as possible to the cylinder cover 821*ad* to communicate with the second space C2 at a moment when the piston 823 is spaced apart from the cylinder cover 821*ad* in a state in which the piston 823 is adhered closely to the cylinder cover 821*ad*.

The first hole 827*a* of the fourth flow path 827 may be formed between the through-portion 821*ac* and the cylinder 822 (more particularly, the second flow path 825), and correspondingly the second hole 827*a* may be formed between the discharge port 424 and the first intermediate pressure hole 425. In addition, the first hole 827*a* of the fourth flow path 827 may be formed by passing through the inside of the plate 821*aa* in the axial direction from the front surface to the rear surface of the plate 821*aa*.

The first block 821*a* may be installed such that the plate 821*aa* may be closely adhered to the end plate 421 of the non-orbiting scroll 420, and the projection portion 821*ab* may be inserted into the ring-shaped wall 150 by passing through a through-hole 821*bb* of the second block 821*b*. In this case, the through-portion 821*ac* may communicate with the discharge port 424 of the non-orbiting scroll 420 and an internal space of the ring-shaped wall 150. The second flow path 825 may communicate with the first intermediate pressure hole 425 of the non-orbiting scroll 420, and the first hole 827*a* of the fourth flow path 827 may communicate with the second intermediate pressure hole 426 of the non-orbiting scroll 420. In addition, a first seal 841 that prevents leakage of a refrigerant flowing from the discharge port 424 to the through-portion 821*ac*, a second seal 851 that prevents leakage of a refrigerant flowing from the first intermediate pressure hole 425 to the second flow path 825, and a third seal 861 that prevents leakage of a refrigerant flowing from the second intermediate pressure hole 426 to the first hole 827*a* of the fourth flow path 827 may be interposed between the first block 821*a* and the non-orbiting scroll 420. The first seal 841 and the third seal 861 may be, respectively, fixed to a first seal fixing groove 842 and a third seal fixing groove 862, which may be formed to be recessed in the rear surface of the plate 821*aa* or a front surface of the end plate 421 of the non-orbiting scroll 420. The second seal 851 may be fixed to a second seal fixing groove 852 formed to be recessed in the front surface of the end plate 421 of the non-orbiting scroll 420. In addition a fourth seal 871 that prevents leakage of a refrigerant flowing from the through-portion 821*ac* to the internal space of the ring-shaped wall 150 may be interposed between the projection portion 821*ab* and the ring-shaped wall 150. The fourth seal 871 may be fixed to a fourth seal fixing groove 872 formed in a ring shape in an outer circumferential surface of the projection 821*ab* or an inner circumferential surface of the ring-shaped wall 150.

The second block 821*b* may be formed in a ring shape h that the through-hole 821*bb*, through which the projection portion b of the first block 821*a* may pass, may be provided at a center of a side of the second block 821*b*. In addition, the second hole 824*b* of the first flow path 824, the third hole 824*c* of the first flow path 824, the second hole 827*b* of the fourth flow path 827, and the fifth flow path 828 may be formed in the second block 821*b*.

The third hole 824*c* of the first flow path 824 may be formed as a groove recessed at a rear surface of the second block 821*b*, and the second hole 824*b* of the first flow path 824 may be formed by passing through an inside of the second block 821*b* from a front surface of the second block 821*b* to the third hole 824*c* of the first flow path 824. The third hole 824*c* of the first flow path 824 may be formed in a ring shape to communicate with the two first holes 824*a* of the first flow path 824. In this embodiment, the third hole 824*c* of the first flow path 824 is formed in a rear surface of the second block 821*b*, but may be formed in the front surface of the first block 821*a*.

The second hole 827*b* of the fourth flow path 827 may be formed by passing through the inside of the second block 821*b* from the front surface to the rear surface of the second block 821*b*. The fifth flow path 828 may be formed by passing through the inside of the second block 821*b* from the front surface to an outer circumferential surface of the second block 821*b*.

The second block 821*b* may be installed such that the projection 821*ab* of the first block 821*a* passes through the through-hole 821*bb*, and the rear surface of the second block 821*b* may be mounted on a front surface of the plate 821*aa* of the first block 821*a*. In this case, the third hole 824*c* of the first flow path 824 may communicate with the two first holes 824*a* of the first flow path 824, and the second hole 827*b* of the fourth flow path 827 may communicate with the first hole 827*a* of the fourth flow path 827. In addition, a fifth seal 881 that prevents leakage of a refrigerant flowing from the first hole 824*a* of the first flow path 824 to the third hole 824*c* the first flow path 824, and a sixth seal 891 that prevents leakage of a refrigerant flowing from the first hole 827*a* of the fourth flow path 827 to the second hole 827*b* of the fourth flow path 827 may be interposed between the second block 821*b* and the first block 821*a*. The fifth seal 881 and the sixth seal 891 may be, respectively, fixed to a fifth seal fixing groove 882 and a sixth seal fixing groove 892, which may be formed to be recessed in the rear surface of the second block 821*b* or the front surface of the plate 821*aa* of the first block 821*a*. The fifth seal 881 may include an inside seal 881*a* provided at one or a first side based on the third hole 824*c* of the first flow path 824 and an outside seal 881*b* provided at the other or a second side based on the third hole 824*c* of the first flow path 824.

The first valve 810 may be coupled to the front surface of the second block 821*b*. In this case, the first input port 811, the second input port 812, and the output port 814 may communicate with the second hole 827*b* of the fourth flow path 827, the fifth flow path 828, and the second hole 824*b* of the first flow path 824, respectively.

Hereinafter, operations of the scroll compressor according to an embodiment will be described. First, the operations related to compression and lubrication will be discussed.

If an operation of an air conditioner is selected, the magnetic clutch MHC may be coupled to the drive pulley (no reference numeral), so that an external drive power may be transmitted to the orbiting scroll 410 through the drive shaft 300. Then, the orbiting scroll 410 may perform an orbiting motion by an eccentric distance in a state in which the orbiting scroll 410 is supported by the main frame 210, and simultaneously, the plurality of compression chambers P including the suction chamber, the intermediate pressure chamber, and the discharge chamber may be successively formed between the orbiting wrap 412 and the non-orbiting wrap 422. A volume of the plurality of compression chambers P may be decreased as the plurality of compression chambers P move in a central direction by a continuous orbiting motion of the orbiting scroll 410 so that a refrigerant may be continuously sectioned in, compressed, and discharged into the discharge space 114 of the casing 100.

Oil may be discharged together with the refrigerant to circulate in a freezing cycle of the air conditioner and then may be collected into the suction space 112 of the casing 100 through the suction pipe 120. The oil may be pumped by pumping power of the oil pump 700 to be supplied to each sliding portion and the compression mechanism through the oil flow path 320 of the drive shaft 300.

Then, a portion of the oil supplied between the orbiting scroll 410 and the drive shaft 300 through the oil flow path 320 may flow downward into the balancing space 222 of the sub-frame 220 and then may be collected in the balancing space 222 of the sub-frame 220. The oil may be pumped up by the main balance weight 350 when the main balance weight 350 is rotated together with the drive shaft 300 to be discharged Into the suction space 112 of the casing 100 through the scattering hole 223. Accordingly, although oil may flow into the balancing space 222 of the sub-frame 220, it is possible to reduce stirring loss between the oil and the main balance weight 350.

However, when an amount of oil flowing into the internal space 110 of the casing 100 is large, a portion of the oil may flow into the balancing space 222 beyond the scattering hole 223 of the sub-frame 220. In particular, a large amount of oil may flow into the internal space 110 of the casing 100 according to an operating condition of the air conditioner. In this case, a considerable amount of the d in the internal space 110 of the casing 100 may flow into the inside of the balancing space 222 through the scattering hole 223, and hence, it may be impossible to discharge the oil flowing into the balancing space 222 outside of the sub-frame 220 by a scattering method using the main balance weight 350. Therefore, stirring loss or noise may be considerably increased.

In consideration of this, in this embodiment, the of discharge hole 218 may be formed in the main frame 210 such that the suction space 112 of the casing 100 may communicate with the plurality of compression chambers P, so that the oil flowing into the suction space 112 of the casing 100 may be moved to the plurality of compression chambers P through the oil discharge hole 218 and discharged, together with the refrigerant, to the freezing cycle of the air conditioner. Accordingly, it is possible to prevent the oil in the internal space 110 of the casing 100 from flowing into the balancing space 222 through the scattering hole 223 of the sub-frame 220.

In this case, the amount of oil flowing in the plurality of compression chambers P may be less than about 10% in comparison with an amount of refrigerant sectioned into the plurality of compression chambers P, and hence, suction loss of the refrigerant may be almost negligible.

The low-pressure type scroll compressor in which the suction pipe 120 communicates with the suction space 112 includes the plurality of suction ends S1 and S2. Therefore, the oil discharge hole 218 should be formed to individually communicate with both of suction ends S1 and S2, so that as oil is uniformly flowing in the inside chamber P1 and the outside chamber P2, the amount of refrigerant sectioned into both of the chambers may also be uniform to an extent. However, when the casing 100 extends in a lateral direction, both of the suction ends S1 and S2 may be formed with a circumferential angle of about 180 degrees so that one suction end S1 may be located at an upper side of the casing 100 and the other suction end S2 may be located at a lower side of the casing 100. Therefore, it is difficult to guide oil to the suction end S1 located at the upper side, and as a result, the oil may flow into the compression chamber through only the suction end S2 located at the lower side.

However, although the oil is flowing into the compression chamber through only the suction end S2 located at the lower side, fine gaps may be generated between front end surfaces of the orbiting wrap 412 and the non-orbiting wrap 422 and the end plates 411 and 421 corresponding thereto. Thus, the oil may be soaked into the other chamber through the gaps, preventing an unbalance of a refrigerant or oil. In addition, although the oil does not directly flow into one of the chambers through the oil discharge hole 218, a certain amount of oil may be contained in a refrigerant sectioned into the one chamber, so that it is possible to prevent, to some degree, shortage of oil in the one chamber.

More particularly, the oil guided to the suction groove S through the oil discharge hole 218 may flow into the suction end that communicates with a chamber having a high compression ratio among the plurality of suction ends S1 and S2, that respectively, communicates with both the chambers P1 and P2. In this case, a pressure difference may be generated between both of the chambers P1 and P2, so that as the oil flowing into the corresponding chamber through the oil discharge hole 218 leaks into the other chamber in the axial direction through the gap generated at an axial direction end of the wrap due to the pressure difference, the unbalance of the refrigerant and oil between the chambers may be compensated.

Next, in a scroll compressor according to embodiments disclosed herein, another embodiment of the oil discharge hole will be discussed hereinafter.

That is, in the previous embodiment, the oil discharge hole 218 is formed at a position that communicates with the internal space 110 of the casing 100, that is, a position outside of the sub-frame 220. However, in this embodiment, as shown FIG. 10, the oil discharge hole 218 may be formed to communicate with the plurality of compression chambers P at an inside of the balancing space 222 of the sub-frame 220. In this case, the oil discharge hole 218 may communicate with the suction groove using a rate pipe or communicate with the suction groove forming a projection at the main frame 210.

In addition, the oil discharge hole 218 may be formed at a middle or midline height of the balancing space 222 for example, near a lowest point, so that oil flowing into the balancing space 222 may be immediately discharged in a direction of the plurality of compression chambers P (that is, the suction end that communicates with the plurality of compression chambers P). Thus, it is possible to minimally manage an amount of oil collected inside of the balancing space 222. In this case, the oil flowing into the balancing space 222 may be immediately discharged in the direction of the plurality of compression chambers P through the oil discharge hole 218. Thus, as oil does not remain inside of the balancing space 222, it is unnecessary to form a separate scattering hole in the sub-frame 220. Accordingly, it is possible to facilitate machining of the sub-frame 220.

When the oil discharge hole 218 is formed to communicate with the inside of the balancing space 222 as described above, the oil flowing into the balancing space 222 may be immediately discharged. Thus, the oil in the balancing space 222 may be easily discharged, and accordingly, it is possible to reduce stirring loss and noise, caused as the main balance weight 350 and the oil are stirred together.

Further, as the scattering hole is removed, it is possible to prevent a large amount of oil from flowing into the balancing space 222 even though the oil is flowing into the internal space 110 of the casing 100. Thus, it is possible to more effectively reduce stirring loss and noise, caused as the main balance weight 350 and the oil are stirred together.

Next, operation of the capacity variation device according to an embodiment will be discussed hereinafter.

That is, if a partial load operation is selected to change from a full load operation state of FIG. 13 to a partial load operation state of FIG. 14), the solenoid needle 813 may be moved in the first valve 810 such that the second input port 812 and the output port 814 communicate with each other. Then, the refrigerant having a suction pressure may flow into the first space C1 from the suction space 112 through the fifth flow path 828, the second input port 812, the output port 814, and the first flow path 824. That is, the suction pressure may be applied to the first space C1.

The refrigerant having a first intermediate pressure may flow into the second space C2 from the first intermediate pressure chamber through the first intermediate pressure hole 425 and the second flow path 825. That is, the first intermediate pressure may be applied to the second space C2.

Accordingly, the piston 823 may be moved toward the first space C1 by a difference in pressure between the first space C1 and the second space C2, to be adhered closely to the front surface of the cylinder 822 (the section at, the side of the first flow path 824). Then, the piston 823 may no longer block the third flow path 825, and the third flow path 826 and the second space C2 may communicate with each other. That is, the bypass flow path may be opened. Accordingly, the refrigerant at the first intermediate pressure which may flow into the second space C2, may be bypassed to the suction space 112 through the third flow path 826. If the bypass is performed, an amount of refrigerant discharged to the freezing cycle through the discharge chamber may be decreased, thereby reducing compression capacity.

On the other hand, if the full load operation is selected (a change from the partial load operation state of FIG. 14 to the full load operation state of FIG. 13), the solenoid needle 813 may be moved in the first valve 810 such that the first input port 811 and the output port 814 communicate with each other. Then, the refrigerant having a second intermediate pressure may flow into the first space C1 from the second intermediate pressure chamber through the second intermediate pressure hole 426, the fourth flour path 827, the first input port 811, the output port 814, and the first flow path 824. That is, the second intermediate pressure may be applied to the first space C1.

A refrigerant having the first intermediate pressure may flow into the second space C2 from the first intermediate pressure chamber through the first intermediate pressure hole 425 and the second low path 825. The refrigerant at the first intermediate pressure, flowing into the second space C2, may be bypassed to the suction space 112 through the third flow path 826. Therefore pressure corresponding to a value between the first intermediate pressure and the suction pressure may be applied to the second space C2.

Accordingly, the piston 823 may be moved toward the second space C2 by a difference in pressure between the first space C1 and second space C2, to be adhered closely to the rear surface of the cylinder 822 (the section at the side of the second flow path 825 or the cylinder cover 821*ad*). Then, the piston 823 may block the third flow path 826, and the third flow path 826 and the second space C2 may be isolated from each other. That is, the bypass flow path may be closed. Accordingly, the bypass may be stopped, and the amount of refrigerant finally discharged to the freezing cycle through the discharge chamber may be increased, thereby in easing compression capacity.

In the scroll compressor according to this embodiment, the capacity varying device 800 may be provided inside of the casing 100, so that it is possible to prevent, in advance, a refrigerant from being leaked outside of the scroll compressor. Also, the capacity varying device 800 may be miniaturized, so that it is possible to reduce the size weight, and manufacturing costs of the scroll compressor.

Further, the bypass flow path of the capacity varying device 800 may be shortened in comparison with when the bypass flow path is formed outside of the scroll compressor, so that it is possible to reduce pressure loss. Furthermore, in the capacity varying device 800, the first valve 810 requiring power in an operation thereof may vary only pressure applied to the second valve 820, and the second valve 820 requiring no power by being operated by a pressure difference may open/close the bypass flow path, so that it is possible to vary a capacity of the scroll compressor with a small operating force, and small power consumption.

Also, as the first valve 810 configured with the solenoid needle 813 may be provided in the suction space 112, the first valve 810 may not be exposed to a high-temperature and high-pressure environment. Accordingly, it is possible to improve operational reliability of the first valve 810.

Additionally, the internal space of the casing 100 may be divided into the suction space 112 and the discharge space 114 using the ring-shaped wall 150 and the capacity varying device 800 (more particularly, the first block 821*a*), so that it is unnecessary to provide a separate high/low pressure separation plate, thereby reducing manufacturing costs.

The block 821 may be provided separately from the non-orbiting scroll 420, and formed by coupling the first block 821*a* and the second block 821*b* to each other, so that it is possible to reduce manufacturing costs. That is, the first block 821*a* and the second block 821*b* may be formed of a material selected in consideration of machining performance, material costs, and required precision, for example, thereby reducing manufacturing costs. Further, a flow path which is difficult to machine using one block, may be machined using the first and second blocks 821*a* and 821*b*, so that it is possible to facilitate machining and reduce manufacturing costs.

Hereinafter, in a scroll compressor according to embodiments disclosed herein, another embodiment of the capacity varying device will be described as follows.

Figure 15:
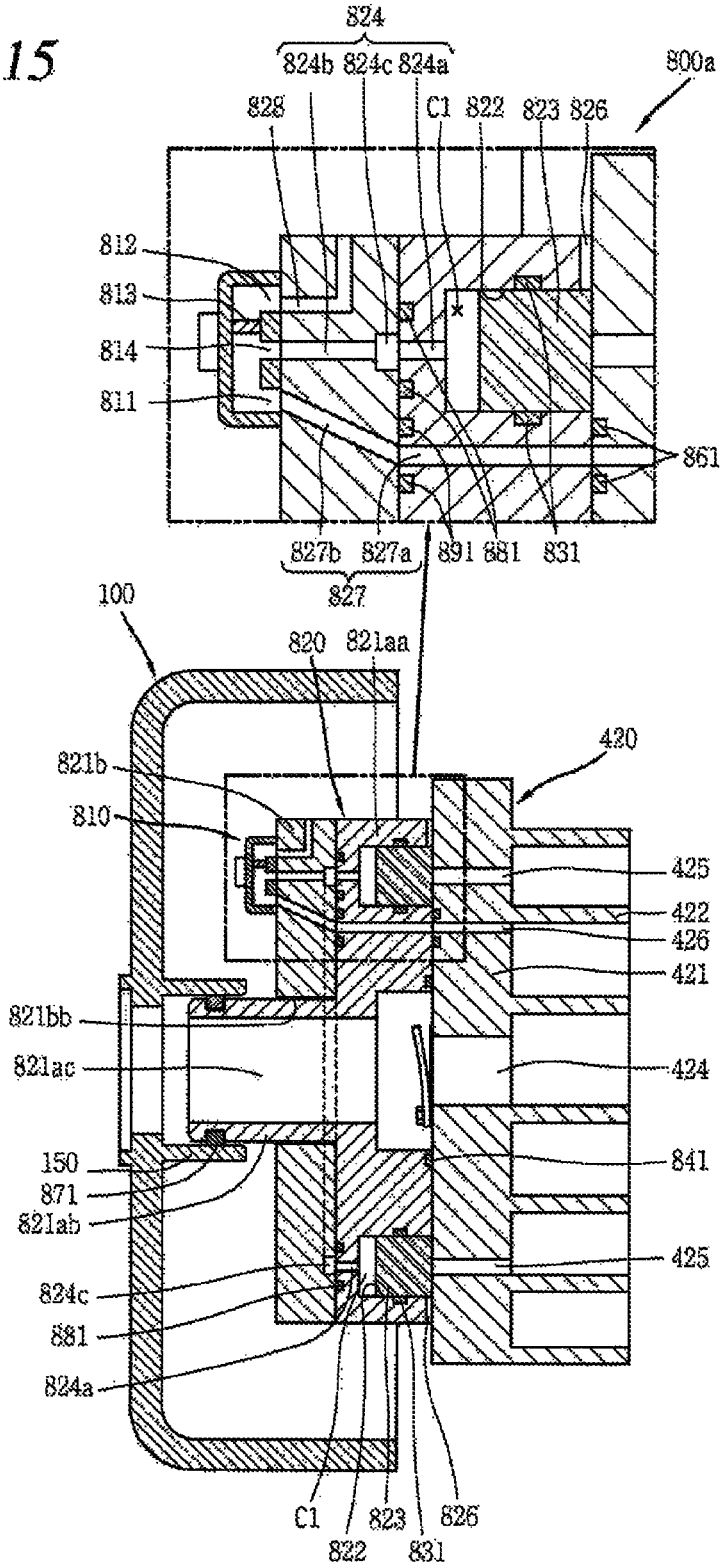
FIG. 15 is a cross-sectional view of another embodiment of the capacity varying device in the scroll compressor of FIG. 2.

FIG. 15 is a cross-sectional view of another embodiment of a capacity varying device in the scroll compressor of FIG. 2. As shown in FIG. 15, the capacity varying device 800*a* according to this embodiment may be formed such that the second space C2 of the cylinder 822 directly communicates with the first intermediate pressure hole 425. In this case, the first intermediate pressure hole 425 may perform a function of the second flow path 825. In addition, the third flow path 826 may be formed to be recessed in the rear surface of the first block 821*a*. This embodiment is slightly disadvantageous in terms of leakage prevention in comparison with the previous embodiment. However, the number of components is decreased, thereby reducing manufacturing costs.

Figure 16:
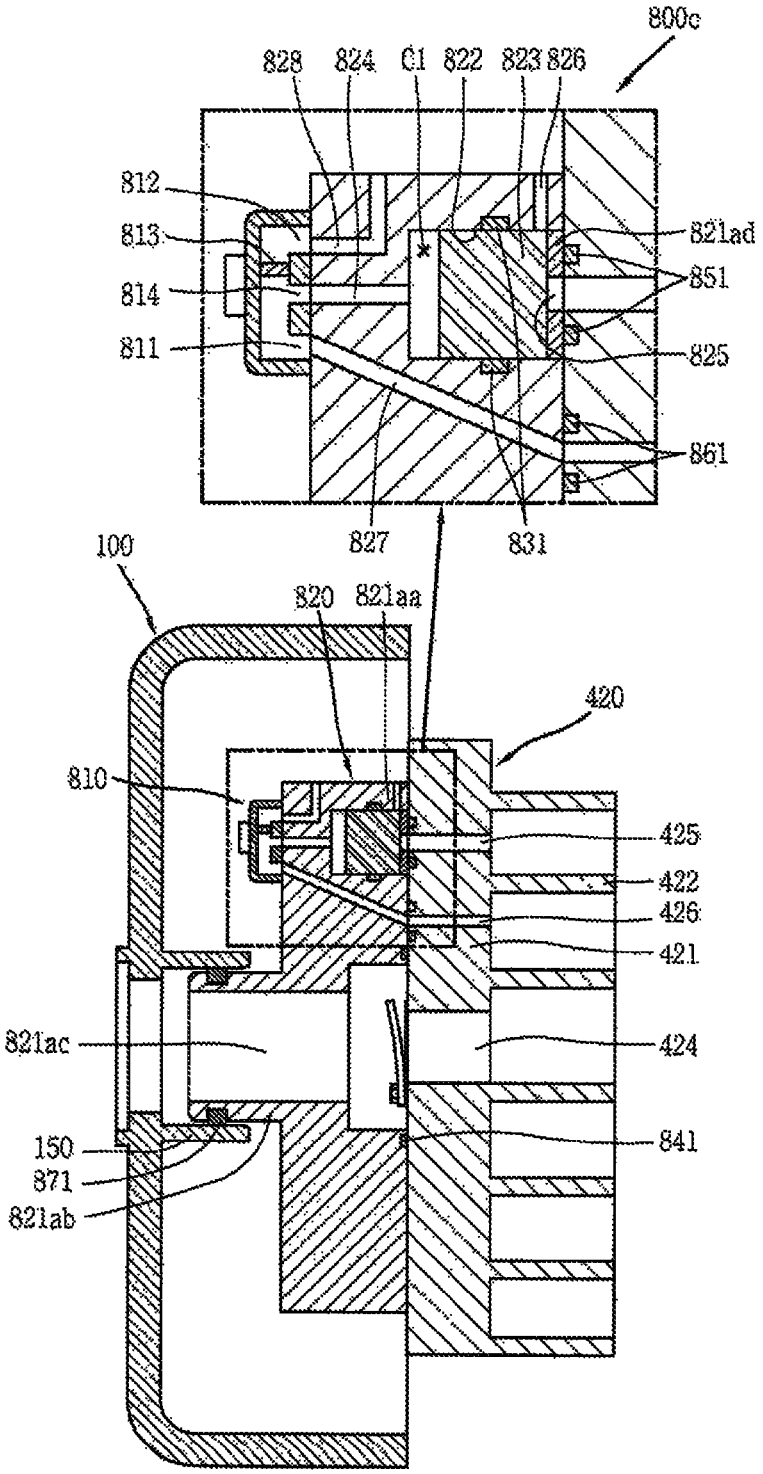
FIG. 16 is a cross-sectional view showing still another embodiment of the capacity varying device in the scroll compressor of FIG. 2.

FIG. 16 is a cross-sectional view showing still another embodiment of a capacity varying device in the scroll compressor of FIG. 2. As shown in FIG. 16, in the capacity varying device according to this embodiment, the number of the bypass flow pass formed may be one. Accordingly, the flow path may be simplified, so that block 821 may be formed as one block structure. This embodiment has a simple structure in comparison with the previous embodiment, thereby reducing manufacturing costs. Further, it is possible to improve operational reliability of the capacity varying device.

Figure 17:
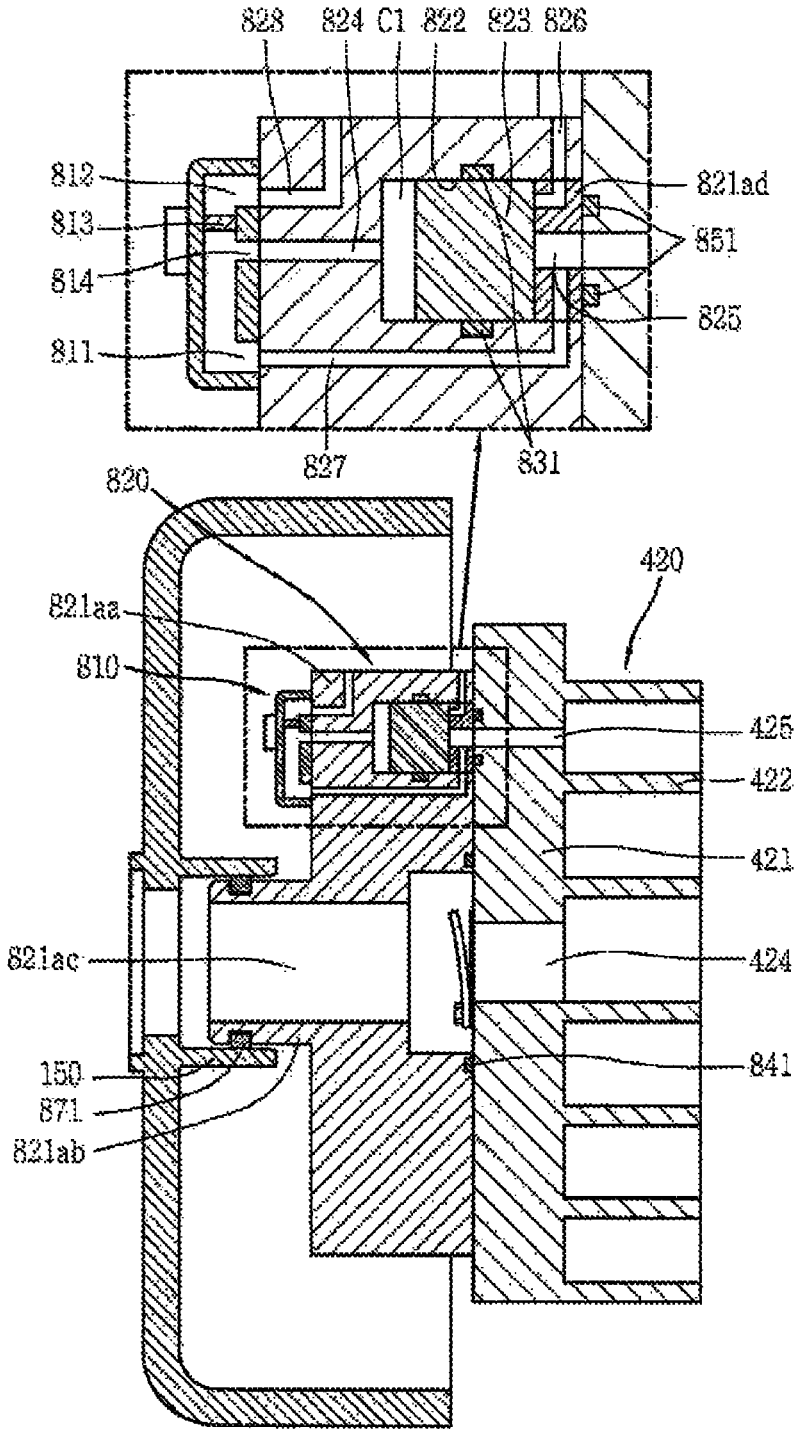
FIG. 17 is a cross-sectional view showing still another embodiment of capacity varying device in the scroll compressor of FIG. 2.
Figure 18:
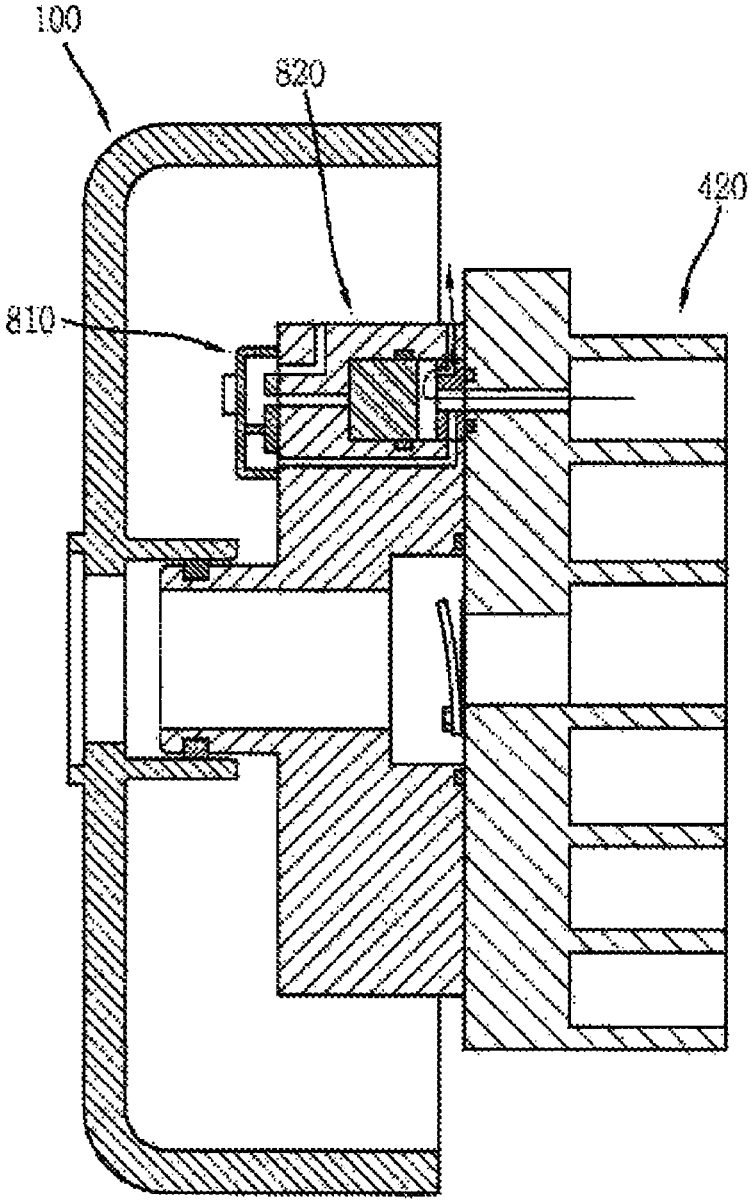
FIG. 18 is a cross-sectional view showing when a partial load operation is performed on the capacity varying device of FIG. 17.
Figure 19:
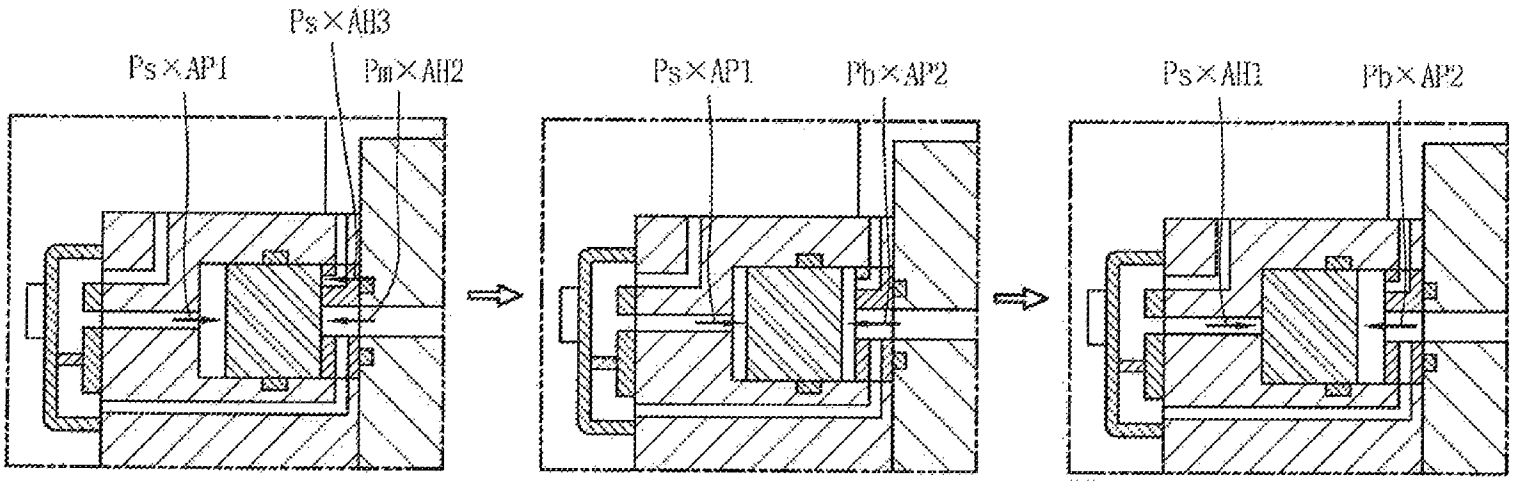
FIG. 19 is a cross-sectional view showing a process in which a state of the capacity varying device is changed from the state of FIG. 17 to the state of FIG. 18.
Figure 20:
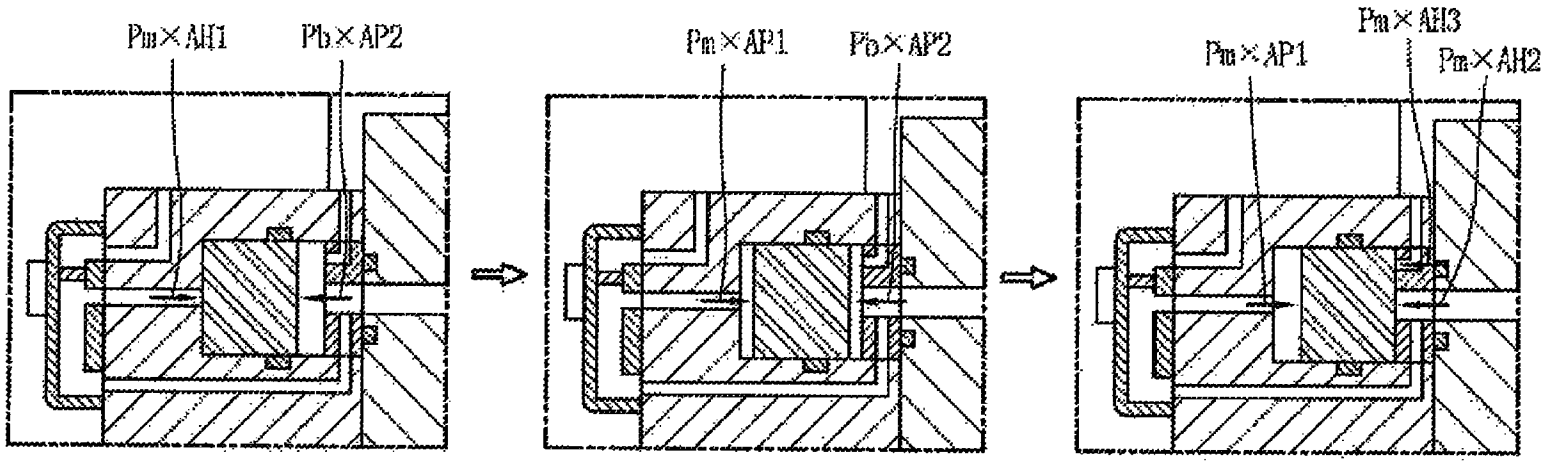
FIG. 20 is a cross-sectional view showing a process in which the state of the capacity varying device is changed from the state of FIG. 18 to the state of FIG. 17.

FIG. 17 is a ross-sectional view of still another embodiment of a capacity varying device in the scroll compressor of FIG. 2. FIG. 18 is a cross-sectional view showing when partial load operation is performed on the capacity varying device of FIG. 17. FIG. 19 is a cross-sectional view showing a process in which a state of the capacity varying device is changed from a state of FIG. 17 to a state of FIG. 18. FIG. 20 is a cross-sectional view showing a process in which the state of the capacity varying device is changed from the state of FIG. 18 to the state of FIG. 17.

In the previous embodiment, the capacity varying device 800 is formed such that the piston 823 is operated by the first intermediate pressure, the second intermediate pressure, and the suction pressure. However, as shown in FIGS. 17 to 20, the capacity varying device 800*c* according to this embodiment may be formed such that the piston 823 is operated by one intermediate pressure and the suction pressure.

More specifically, one intermediate pressure hole 425 may be formed in the end plate 421 of the non-orbiting scroll 420. The second flow path 825 may be formed to allow the intermediate pressure hole 425 and the second space C2 to communicate with each other, and the fourth flow path 827 may be formed to allow the second flow path 825 and the first input port 811 to communicate with each other. In addition, the third flow path 826 may be formed to pass from the rear surface of the cylinder 822 (more particularly, the front surface of the cylinder cover 821*ad*) to the outer circumferential surface of the block 821 such that one opening of the third flow path 826 may be opposite to the rear surface of the piston 823.

When the suction pressure as the pressure of the suction space 112 is Ps, the pressure of the intermediate pressure chamber communicating the intermediate pressure hole 425 is Pm, the pressure of the second space C2 when the bypass is performed (when the piston 823 is moved to the first space C1 such that the second and third flow paths 825 and 826 communicate with each other) is Pb, an area of the front surface of the piston 823 (the section at the side of the first space C1) is AP1, an area of the rear surface of the piston 823 the section at the side of the second space C2) is AP2, an area of the opening of the first flow path 824 at the side of the first space C1 is AH2, an area of the opening of the second flow path 825 at the side of the second pace C2 is AH2, and an area of the opening of the third flow path 826 at the side of the second space C2 is AH3, relations of the following Expression 1 to 4 may be established.

$$Ps<Pb<Pm \quad \text{Expression 1}$$

$$AP1=AP2 \quad \text{Expression 2}$$

$$AP1>AH1 \quad \text{Expression 3}$$

$$AP2>AH2+AH3 \quad \text{Expression 4}$$

In addition, the capacity varying device 800*c* according to this embodiment, as shown in FIG. 19, may be formed such that when a change from the full load operation state to the partial load operation state is performed as the second input port 821 and the output port 814 communicate with each other, a force applied to the rear surface of the piston 823, forming the side of the second space C2, is greater than a force applied to the front surface of the piston 823. That is the capacity varying device 800*c* according to this embodiment may be formed such that the relation of the following Expression 5 is satisfied in a state in which the piston 823 is adhered closely to the rear surface of the cylinder 822, the relation of the following Expression 6 is satisfied in a state in which the piston 823 are spaced apart from both the front and rear surfaces of the cylinder 822, and the relation of the following Expression 7 is satisfied in a state in which the change in state is completed as the piston 823 is adhered closely to the front surface of the cylinder 822.

$$Ps\times AP1<Pm\times AH2+Ps\times AH3 \quad \text{Expression 5}$$

$$Ps\times AP1<Pb\times AP2 \quad \text{Expression 6}$$

$$Ps\times AH1<Pb\times AP2 \quad \text{Expression 7}$$

In addition, as shown in FIG. 20, the capacity varying device 800*c* according to this embodiment, may be formed s on that when a change from the partial load operation state to the full load operation state occurs, as the first input port 811 and the output port 814 communicate with each other, a force applied to the front surface of the piston 823 may be greater than a force applied to the rear surface of the piston 823. That is, the capacity varying device 800*c* according to this embodiment may be formed such that the relation of the following Expression 8 is satisfied in a state in which the piston 823 is adhered closely to the front surface of the cylinder 822, the relation of the following Expression 9 is satisfied in a state in which the piston 823 is spaced apart from both the front and rear surfaces of the cylinder 822, and the relation of the following Expression 10 is satisfied in a state in which the change in mode is completed as the piston 823 is adhered closely to the rear surface of the cylinder 822.

$$Pm\times AH1>Pb\times AP2 \quad \text{Expression 8}$$

$$Pm\times AP1>Pb\times AP2 \quad \text{Expression 9}$$

$$Pm\times AP1>Pm\times AH2+Ps\times AH3 \quad \text{Expression 10}$$

In this embodiment, the capacity varying device 800*c* may be configured to have any one of the first intermediate pressure hole 425 and the second intermediate pressure hole 426, which are provided in the previous embodiment, so that it is possible to simplify the structure of the capacity varying device and reduce manufacturing costs. Also, as the pressure of the first input port 811, which acts as a resistance factor in the operation of the first valve 810, is applied as the first intermediate pressure, so that the first valve 810 may be operated with a small operating force, and small power consumption. In addition, the number of the bypass flow path may be formed as one, and the block 821 may be formed as one block structure, thereby simplifying the structure of the capacity varying device. Accordingly, manufacturing costs may be further reduced, and an operational reliability of the capacity varying device may be improved.

In the scroll compressor according to embodiments disclosed herein, the capacity varying device may be provided inside of the casing, so that it is possible to prevent, in advance, a refrigerant from leaking outside of the scroll compressor. In addition, the bypass flow path of the capacity varying device may be shortened in comparison to when the bypass flow path is formed to pass outside of the scroll compressor, so that it is possible to reduce pressure loss. Further the capacity varying device may be miniaturized so that it is possible to reduce a size, weight, and manufacturing costs of the compressor. Also, in the capacity varying device, the first valve requiring power in an operation thereof may vary only pressure applied to the second valve, and the second valve operated by a pressure difference may open/close the bypass flow path, so that it is possible to vary the capacity of the scroll compressor with a small operating force, and small power consumption.

Embodiments disclosed herein provide a scroll compressor including a capacity varying device, which may prevent a refrigerant from being leaked outside of the scroll compressor, reduce pressure loss in a bypass flow path, and decrease a size, weight, and manufacturing costs of the scroll compressor. Embodiments disclosed herein further provide a scroll compressor capable of varying a capacity of the compressor with a small operating force, and small power consumption.

Embodiments disclosed herein provide a scroll compressor that may include a casing; an orbiting scroll and a non-orbiting scroll forming two pairs or a plurality of compression; chambers, the orbiting scroll and the non-orbiting scroll sectioning in and compressing a refrigerant from a suction space of the casing to discharge the refrigerant into a discharge space of the casing; and a capacity varying unit or device that selectively bypasses a portion of a refrigerant in the compression chambers.

The capacity varying unit may include a first valve mechanism or valve having a first input port that communicates with the compression chambers, a second input port that communicates with the suction space of the casing, and an output port that communicates with the first or second input port; and a second valve mechanism or valve having, inside a block, a cylinder, a piston that divides an internal space of the cylinder into a first space and a second space, the piston being provided to be movable in the internal space of the cylinder by the first valve mechanism, a first flow path that allows the first space and the output port to communicate with each other, a second flow path that allows the second space and the compression chambers to communicate with each other, and a third flow path that allows the second space and the suction space of the casing to communicate with each other when the piston is moved toward the first space. A compression chamber that communicates with the first input port may have a higher pressure than a compression chamber that communicates with the second space.

The non-orbiting scroll may include a first intermediate pressure hole that communicates with a compression chamber to which a first intermediate pressure defined as a value between a suction pressure and a discharge pressure may be applied; and second intermediate pressure hole that communicates with a compression chamber to which a second intermediate pressure defined as a value between the first intermediate pressure and the discharge pressure may be applied. The first intermediate pressure hole may communicate with a second flow path, and the second intermediate pressure hole may communicate with the first input port.

Each of the first intermediate pressure hole, the second flow path, a cylinder, a piston, and a third flow path may be provided in plurality, and a number of each of the second intermediate pressure hole and the first valve mechanism may be provided as one. The first flow path may be formed to allow the output port of the one first valve mechanism and the first space of the plurality of cylinders to communicate with each other. The block may include a first block coupled to the non-orbiting scroll, and a second block coupled to the first block. The second block may have the first valve mechanism mounted thereto.

A portion of the first flow path, the second flow path, the third flow path, the cylinder, and the piston may be provided in the first block, and the other or a second portion of the first flow path may be provided in the second block. The first flow path may include a plurality of first holes that, respectively, communicate with first spaces of the plurality of the cylinder; one second hole that communicates with the one output port; and a third hole that allows the plurality of first holes and the one second hole to communicate with each other. The first hole of the first flow path may be formed in the first block, the second hole of the first flow path may be formed in the second block, and the third hole of the first flow path may be formed as a groove recessed in a contact surface of the first block with the second block or a contact surface of the second block with the first block. The first input port and the second space ma y communicate with each other in a compression chamber having a same pressure.

The second valve mechanism may further include a fourth flow path that allows the first input port and the compression chambers to communicate with each other and a fifth flow path that allows a second input port and the suction space to communicate with each other, which may be provided inside of the block. The non-orbiting scroll may include an intermediate pressure hole that communicates with a compression chamber to which, an intermediate pressure defined as a value between a suction pressure and a discharge pressure may be applied. The intermediate pressure hole may communicate with the second flow, path, and the fourth flow path may communicate with the second flow path.

Openings of the second and third flow paths at the side of a second space may be opposite to a section of the piston at the side of the second space. When an area of a section of the piston at the side of the first space is AP1, an area of a section of the piston at the side of the second space is AP2, an area of an opening of the first flow path at the side of the first space is AH1, an area of an opening of the second flow path at the side of the second pace is AH2, and an area of an opening of the third flow path at the side of the second space is AH3 the first flow path, the second flow path, the third flow path, and the piston may be formed to satisfy a relation of AP1>AH1 and AP2>AH2+AH3. The intermediate pressure hole, the first flow path, the second flow path, the third flow path, and the piston may be formed to satisfy a relation of Ps×AP1<Pm×AH2+Ps×AH3, Ps×AP1<Pb×AP2, and Ps×AH1<Pb×AP2.

The first valve mechanism may be provided in the suction space. A ring-shaped wall portion or wall that protrudes from an inner wall surface of the casing may be formed at the casing, a through-portion that guides the refrigerant discharged from the compression chambers into an internal space of the ring-shape wall portion may be formed in the block, and the discharge space of the casing may be formed with the ring-shaped wall portion and the through-portion.

Embodiments disclosed herein provide a scroll compressor that may include a casing; an orbiting scroll and a non-orbiting scroll forming two pairs of or a plurality of compression chambers, the orbiting scroll and the non-orbiting scroll sectioning in and compressing a refrigerant from a suction space of the casing and discharging the refrigerant into a discharge space of the casing; a first valve mechanism valve operated by a signal input from the outside of the casing; and a second valve mechanism or valve interlocked with the first valve mechanism to selectively bypass a portion of a refrigerant in the compression chambers. The first valve mechanism and the second valve mechanism may be installed in the suction space of the casing.

Any reference in this specification to "one embodiment." "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A scroll compressor, comprising:

a casing having a suction space;

a non-orbiting scroll provided in the suction space of the casing;

an orbiting scroll coupled to the non-orbiting scroll, the orbiting scroll forming, together with the non-orbiting scroll, a plurality of compression chambers;

a first valve having a first input port that communicates with the plurality of compression chambers, a second input port that communicates with the suction space of the casing, and an output port that communicates with the first input port or the second input port, wherein the first valve is installed in the suction space of the casing; and at least one second valve having a cylinder, a piston that divides an internal space of the cylinder into a first space and a second space, the piston being movable in the internal space of the cylinder by the first valve, a first flow path by which the first space and the output port communicate with each other, a second flow path by which the second space and the plurality of compression chambers communicate with each other, and a third flow path by which the second space and the suction space of the casing communicate with each other when the piston moves toward the first space, wherein the at least one second valve is installed in the suction space of the casing, wherein the first input port communicates with a compression chamber of the plurality of compression chambers having a pressure higher than a pressure of a compression chamber of the plurality of compression chambers that communicates with the second space wherein the at least one second valve includes:

at least one first intermediate pressure hole that communicates with a compression chamber of the plurality of compression chambers to which a first intermediate pressure defined as a value between a suction pressure and a discharge pressure is applied; and a second intermediate pressure hole that communicates with a compression chamber of the plurality of compression chambers to which a second intermediate pressure defined as a value between the first intermediate pressure and the discharge pressure is applied, and wherein the at least one first intermediate pressure hole communicates with the second flow path, and the second intermediate pressure hole communicates with the first input port, wherein the at least one second valve includes a plurality of second valves, and wherein a plurality of first flow paths provided in each of the plurality of second valves is connected in parallel to the output port.

2. The scroll compressor of claim 1, wherein a single block provided with the first valve and the at least one second valve is coupled to the non-orbiting scroll.

3. The scroll compressor of claim 1, wherein at least one block provided with the first valve and the at least one second valve is coupled to the non-orbiting scroll, and wherein the at least one block includes:

a first block coupled to the non-orbiting scroll; and a second block coupled to the first block, wherein the first valve is mounted on the second block.

4. The scroll compressor of claim 1, wherein at least one block provided with the first valve and the at least one second valve is coupled to the non-orbiting scroll, wherein a through-projection that guides a refrigerant discharged from the plurality of compression chambers is formed at the at least one block, and wherein the through-projection is sealing-coupled to a ring-shaped wall that protrudes from an inner wall surface of the casing to be connected to a discharge pipe that communicates with the casing.

5. A scroll compressor, comprising:

a casing;

an orbiting scroll and a non-orbiting scroll forming a plurality of compression chambers, the orbiting scroll and the non-orbiting scroll suctioning in and compressing a refrigerant from a suction space of the casing to discharge the refrigerant into a discharge space of the casing;

a first valve operated by a signal input from outside of the casing; and at least one second valve coupled with the first valve to selectively bypass a portion of a refrigerant in the plurality of compression chambers, wherein the first valve and the at least one second valve are installed within the suction space of the casing wherein at least one block is coupled to the non-orbiting scroll, wherein the first valve and the at least second valve are provided in the at least one block, wherein the first valve includes a first input port that communicates with a compression chamber of the plurality of compression chambers having a higher pressure than a pressure of a compression chamber of the plurality of compression chambers that communicates with the suction space, wherein the non-orbiting scroll includes:

at least one first intermediate pressure hole that communicates with a compression chamber of the plurality of compression chambers to which a first intermediate pressure defined as a value between a suction pressure and a discharge pressure is applied; and a second intermediate pressure hole that communicates with a compression chamber of the plurality of compression chambers to which a second intermediate pressure defined as a value between the at least one first intermediate pressure and the discharge pressure is applied, wherein the at least one first intermediate pressure hole communicates with a second flow path, and the second intermediate pressure hole communicates with the first input port, wherein, in the at least one block, a plurality of each of the at least one first intermediate pressure hole, the second flow path, a cylinder, a piston, and a third flow path is provided and one of each of the second intermediate pressure hole and the first valve is provided, and wherein a first flow path is formed to allow an output port of the one first valve and a first space of the plurality of cylinders to communicate with each other.

6. The scroll compressor of claim 5, wherein that least one block includes:

a first block coupled to the non-orbiting scroll; and a second block coupled to the first block, the second block having the first valve mounted thereto, wherein a first portion of the first flow path, and one of each of the plurality of the second flow path, the third flow path, the cylinder, and the piston are provided in the first block, and a second portion of the first flow path is provided in the second block.

7. The scroll compressor of claim 6, wherein the first flow path includes:

a plurality of first holes that, respectively, communicates with a first space of the cylinder;

a second hole that communicates with the output port; and a third hole by which the plurality of first holes and the second hole communicate with each other, wherein the plurality of first holes of the first flow path is formed in the first block, the second hole of the first flow path is formed in the second block, and the third hole of the first flow path is formed as a groove recessed in a contact surface of the first block with the second block or a contact surface of the second block with the first block.

8. A scroll compressor, comprising a casing;

an orbiting scroll and a non-orbiting scroll forming a plurality of compression chambers, the orbiting scroll and the non-orbiting scroll suctioning in and compressing a refrigerant from a suction space of the casing to discharge the refrigerant into a discharge space of the casing;

a first valve operated by a signal input from outside of the casing; and at least one second valve coupled with the first valve to selectively bypass a portion of a refrigerant in the plurality of compression chambers, wherein the first valve and the at least one second valve are installed within the suction space of the casing, wherein the at least one second valve includes a first flow path by which a first input port of the first valve and the plurality of compression chambers communicate with each other and a second flow path by which a second input port of the first valve and the suction space communicate with each other, which are provided inside of at least one block having a cylinder having a first space and a second space separated by a piston, wherein the non-orbiting scroll includes an intermediate pressure hole that communicates with a compression chamber of the plurality of compression chambers to which an intermediate pressure defined as a value between a suction pressure and a discharge pressure is applied, wherein the intermediate pressure hole communicates with a third flow path provided in the at least one block, and wherein the first flow path communicates with the third flow path.

9. The scroll compressor of claim 8, wherein openings of a fourth flow path and a fifth flow path provided in the at least one block at a side of the second space of the cylinder are opposite to a section of the piston at the side of the second space.

10. The scroll compressor of claim 9, wherein, when an area of a section of the piston at a side of the first space of the cylinder is AP1, an area of a section of the piston at a side of the second space is AP2, an area of an opening of the second flow path at the side of the first space is AH1, an area of an opening of the fourth flow path at the side of the second space is AH2, and an area of an opening of the fifth flow path at the side of the second space is AH3, the first flow path, the fourth flow path, the fifth flow path, and the piston satisfy a relation of AP1>AH1 and AP2>AH2+AH3.

* * * * *